US011252989B2

(12) United States Patent
Howe et al.

(10) Patent No.: US 11,252,989 B2
(45) Date of Patent: Feb. 22, 2022

(54) TONGUE FOR ROD FORMING APPARATUS, TONGUE SUPPORT ASSEMBLY WITH TONGUE, ROD FORMING APPARATUS WITH TONGUE, AND METHOD THEREOF

(71) Applicant: Altria Client Services LLC, Richmond, VA (US)

(72) Inventors: Charles David Howe, Crewe, VA (US); Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/663,787

(22) Filed: Oct. 25, 2019

(65) Prior Publication Data

US 2021/0120862 A1 Apr. 29, 2021

(51) Int. Cl.
*A24C 5/18* (2006.01)
*A24C 1/02* (2006.01)

(52) U.S. Cl.
CPC ..... *A24C 5/1807* (2013.01); *A24C 1/02* (2013.01); *A24C 5/1842* (2013.01)

(58) Field of Classification Search
CPC ..... A24C 1/02; A24C 5/1807; A24C 5/1842; A24C 5/18
See application file for complete search history.

(56) References Cited

U.S. PATENT DOCUMENTS 1,630,488 A 5/1927 Di Ianni
4,010,762 A 3/1977 Strydom
4,619,276 A 10/1986 Albertson et al.
4,917,118 A * 4/1990 Mangiarotti ..... A24C 5/1835 131/84.1
4,979,521 A 12/1990 Davis et al.
5,413,121 A 5/1995 Dawson et al.
5,810,016 A 9/1998 Okumoto
7,827,994 B2 11/2010 Spiers et al.
9,295,284 B2 3/2016 Prestia et al.
2007/0193591 A1 8/2007 Andersen et al.
2014/0048083 A1 2/2014 Williams et al.
2017/0013872 A1 1/2017 Williams et al.

FOREIGN PATENT DOCUMENTS

GB 579029 A 7/1946

OTHER PUBLICATIONS

Notice of Allowance dated Jul. 21, 2021, issued in corresponding U.S. Appl. No. 16/663,886.

* cited by examiner

*Primary Examiner* — Eric Yaary
(74) *Attorney, Agent, or Firm* — Harness, Dickey & Pierce, P.L.C.

(57) ABSTRACT

The tongue includes a major body, where the major body has a first longitudinal length that runs from a first end to a second end of the major body. The major body includes a first channel defined along a first edge of the major body, and a second channel defined along a second edge of the major body. The first channel and the second channel is hollow and runs substantially along the first longitudinal length from the first end to the second end of the major body. The first channel and the second channel oppose each other and face away from each other. The tongue support assembly and the rod forming apparatus include the tongue. The method aligns the tongue with a lower plate of a compression box.

49 Claims, 27 Drawing Sheets

(VIEW F-F)

(VIEW G-G)

(VIEW H-H)

(VIEW A-A)

(VIEW B-B)

(VIEW C-C)

(VIEW D-D)

TONGUE FOR ROD FORMING APPARATUS, TONGUE SUPPORT ASSEMBLY WITH TONGUE, ROD FORMING APPARATUS WITH TONGUE, AND METHOD THEREOF

BACKGROUND

Field

Example embodiments generally relate to a tongue for a rod forming apparatus, a rod forming apparatus with the tongue, and a method of installing the tongue on the rod forming apparatus.

Description of Related Art

During the manufacture of cigars, tobacco can have a relatively high cost. Therefore, an efficient use of tobacco is important. High-quality cigars should be uniformly and consistently filled.

SUMMARY

At least one example embodiment is directed toward a tongue for rod forming.

In one embodiment, the tongue includes a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other.

In one embodiment, the major body further includes: a first portion, the first portion defining the first channel, and a second portion, the second portion being connected to the first portion, the second portion defining the second channel, wherein the first portion and the second portion are identical to each other.

In one embodiment, the first channel includes a first inner surface, the second channel includes a second inner surface, and the first inner surface and the second inner surface both have a substantially arcuate-shaped cross-sectional profile.

In one embodiment, the first inner surface has a first radius of curvature, the second inner surface has a second radius of curvature, and the first radius of curvature and the second radius of curvature each continually reduce in size from the first end to the second end of the major body.

In one embodiment, the first channel has a first width, the second channel has a second width, and the first width and the second width each continually reduce in size from the first end of the major body to the second end of the major body.

In one embodiment, the major body includes: a first sidewall and a second sidewall that oppose each other, the first sidewall and the second sidewall converging towards each other from the first end to the second end of the major body to cause the major body to have a tapered profile.

In one embodiment, the first channel has a first width, the second channel has a second width, and the first width and the second width each substantially span from the first sidewall to the second sidewall to cause each of the first channel and the second channel to have a tapered profile.

In one embodiment, the first channel includes a first opening, the second channel includes a second opening, and the first opening and the second opening each have a cross-sectional profile that is one of rectangular-shaped or square-shaped.

In one embodiment, the first channel includes a first tapered entrance between the first opening and a first end of the first inner surface, and the second channel includes a second tapered entrance between the second opening and a first end of the second inner surface.

In one embodiment, the first tapered entrance includes a first inclined surface between the first opening and a first end of the first inner surface, and the second tapered entrance includes a second inclined surface between the second opening and a first end of the second inner surface.

In one embodiment, the first tapered entrance includes a first pair of sloped sidewalls on adjacent sides of the first inclined surface, and the second tapered entrance includes a second pair of sloped sidewalls on adjacent sides of the second inclined surface.

In one embodiment, the major body includes: a first sidewall defining a first groove running substantially along the first longitudinal length, the first groove being adjacent to the first channel, and a second sidewall defining a second groove running substantially along the first longitudinal length, the second groove being adjacent to the second channel.

In one embodiment, the first groove includes a first tapered end and a first enlarged end, and the second groove includes a second tapered end and a second enlarged end, the first tapered end and the second tapered end being at least partially defined by the first end of the major body, and the first enlarged end and the second enlarged end are at least partially defined by the second end of the major body.

In one embodiment, the first enlarged end of the first groove includes a first irregularly shaped convex edge that includes a first sharply angled portion and a first substantially horizontal portion, and the second enlarged end of the second groove includes a second irregularly shaped convex edge that includes a second sharply angled portion and a second substantially horizontal portion.

In one embodiment, the first substantially horizontal portion and the second substantially horizontal portion are respectively angled to be about perpendicular to the first sidewall and the second sidewall of the major body.

In one embodiment, the major body includes a first endwall and a second endwall on the first end and the second end of the major body, respectively, and the first sharply angled portion and the second sharply angled portion each traverse across a first centerline, the first centerline running through a center of a second longitudinal length of the second endwall of the major body.

In one embodiment, the first sidewall defines a third groove, and the second sidewall defines a fourth groove, the third groove and the fourth groove being substantially at a same elevation of the major body.

In one embodiment, the third groove and the fourth groove exist along a first plane, the first plane dividing the tongue into a first portion and a second portion, the first portion defining the first channel and the second portion defining the second channel, the first portion and the second portion being identical to each other.

In one embodiment, the major body defines at least one first injection port and at least one second injection port, the at least one first injection port traversing through a first inner surface of the first channel and the at least one second injection port traversing through a second inner surface of the second channel.

In one embodiment, the first channel includes a first opening, and the second channel includes a second opening, and the first opening and the second opening each have an interior width that is about 7-12 mm wide and an interior depth that is about 7-12 mm.

In one embodiment, a first length of the first tapered entrance and a second length of the second tapered entrance are each about 5-20% of the first longitudinal length of the major body.

In one embodiment, a first length of the first tapered entrance and a second length of the second tapered entrance are each about 5-10% of the first longitudinal length of the major body.

In one embodiment, the first longitudinal length of the major body is about 115-160 mm.

In one embodiment, the first tapered end and the second tapered end each are about 2.0-3.0 mm wide, and the first enlarged end and the second enlarged end each are about 6.0-8.0 mm wide.

At least another example embodiment is directed toward a tongue support assembly with a tongue.

In one embodiment, the tongue support assembly includes a tongue; and a tongue holder configured to selectively hold the tongue in one of a first position and a second position, the tongue including a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other, and wherein the first position causes the first channel of the tongue to extend from the tongue holder and the second position causes the second channel to extend from the tongue holder.

In one embodiment, the tongue holder includes: a hollow body, the hollow body including engaging structure that mates with opposing grooves defined by a first sidewall and a second sidewall of the tongue to selectively hold the tongue in one of the first position and the second position.

In one embodiment, the engaging structure includes ribs that oppose each other, the ribs converging towards each other from a first end to a second end of the hollow body, and a first sidewall and a second sidewall of the tongue both converge towards each other along the first longitudinal length of the major body so that the tongue can be wedged between the ribs as the tongue is inserted into the hollow body in a direction that is toward the second end of the hollow body.

In one embodiment, the tongue support assembly further comprise: a base, the base being configured to connect the tongue support assembly to a rod forming apparatus; and an arm configured to hold the tongue holder, the arm being slideably positioned on the base to assist the tongue support assembly in positioning the tongue on a lower plate of the rod forming apparatus to form a compression box, the tongue holder being configured to align the first channel with a groove defined by the lower plate if the tongue is in the first position, and the tongue holder being configured to align the second channel with the groove if the tongue is in the second position.

At least another example embodiment is directed toward a rod forming apparatus for forming consumer product into a rod.

In one embodiment, the rod forming apparatus includes an in-feed section configured to convey a column of tobacco in a downward direction, the in-feed section having a discharge end; and a finishing section configured to receive the column of tobacco from the discharge end, the finishing section being configured to compress and roll the column of tobacco into a tobacco rod that is wrapped, the finishing section including a compression box, the compression box including, a tongue, the tongue including, a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other, and a lower plate defining a first groove, the tongue configured to be oriented in one of a first position and a second position, the first position causing the first channel to be aligned with the first groove to interface with the discharge end, and the second position causing the second channel to be aligned with the first groove to interface with the discharge end.

In one embodiment, the major body of the tongue further includes: a first portion, the first portion defining the first channel, and a second portion, the second portion connected to the first portion, the second portion defining the second channel, wherein the first portion and the second portion are identical to each other.

In one embodiment, the first channel includes a first inner surface, the second channel includes a second inner surface, and the first inner surface and the second inner surface both have a substantially arcuate-shaped cross-sectional profile that has a continually reducing radius of curvature from the first end to the second end of the major body.

In one embodiment, the major body of the tongue includes, a first sidewall and a second sidewall that oppose each other, the first sidewall and the second sidewall converging towards each other from the first end to the second end of the major body to cause the major body to have a tapered profile.

In one embodiment, the first channel includes a first opening, the second channel includes a second opening, and the first opening and the second opening each have a cross-sectional profile that is one of rectangular-shaped or square-shaped.

In one embodiment, the first channel includes a first tapered entrance between the first opening and a first end of the first inner surface, and the second channel includes a second tapered entrance between the second opening and a first end of the second inner surface.

In one embodiment, the major body of the tongue includes: a first sidewall defining a second groove running substantially along the first longitudinal length, the second groove being adjacent to the first channel, and a second sidewall defining a third groove running substantially along the first longitudinal length, the third groove being adjacent to the second channel.

In one embodiment, the first groove includes a first tapered end and a first enlarged end, and the second groove includes a second tapered end and a second enlarged end, the first tapered end and the second tapered end being on the first end of the major body and the first enlarged end and the second enlarged end being on the second end of the major body.

In one embodiment, the first sidewall defines a fourth groove, and the second sidewall defines a fifth groove, the fourth groove and the fifth groove being substantially at a same elevation of the major body.

In one embodiment, the rod forming apparatus further includes a tongue support assembly, including, a tongue holder configured to hold the tongue, a base, and an arm configured to hold the tongue holder, the arm being slideably positioned on the base to assist the tongue support assembly in positioning the tongue on the lower plate, the tongue holder being configured to selectively orient the tongue in the first position or the second position.

In one embodiment, the tongue holder including a hollow body with ribs that oppose each other, the ribs converging towards each other from a first end to a second end of the hollow body, and a first sidewall and a second sidewall of the tongue both converge towards each other along the first longitudinal length of the major body so that the tongue can be wedged between the ribs as the tongue is inserted into the hollow body in a direction that is toward the second end of the hollow body.

In one embodiment, the first channel includes a first opening, the second channel includes a second opening, and the first opening and the second opening each have an interior width that is about 5-15% larger than a width of discharge end.

In one embodiment, the first channel includes a first opening, the second channel includes a second opening, and the first opening and the second opening each have an interior width that is about 0.25-1.5 mm larger than a width of the discharge end.

In one embodiment, the first channel includes a first opening, the second channel includes a second opening, and the first opening and the second opening each have an interior width that is about 7-12 mm wide and an interior depth that is about 7-12 mm.

In one embodiment, a width and a depth of the discharge end each are about 5-10 mm.

In one embodiment, a first length of the first tapered entrance and a second length of the second tapered entrance are each about 5-10% of the first longitudinal length of the major body.

In one embodiment, the first longitudinal length of the major body is about 115-160 mm.

In one embodiment, the finishing section further includes: an adhesive applicator, the adhesive applicator being configured to apply an adhesive to a portion of at least one covering, after the at least one covering passes through the compression box, one or more folders downstream of the compression box, the one or more folders being configured to fold the at least one covering, with the adhesive, around a tobacco rod formed by the compression box, and a cutter, the cutter being configured to cut the tobacco rod into rolled consumer products.

In one embodiment, the in-feed section further includes: an upper belt and an in-feed belt, the upper belt and the in-feed belt defining a descending channel, the descending channel being configured to convey a column of tobacco in the downward direction, a pair of squeeze bars configured to receive the column of tobacco from the descending channel, the pair of squeeze bars being configured to compress the column of tobacco, the pair of squeeze bars at least partially defining the discharge end of the in-feed section, a lower belt configured to move the column of tobacco through the pair of squeeze bars and into the finishing section, and the lower belt being further configured to move the at least one covering, below the column of tobacco, into the finishing section.

At least one example embodiment is directed toward a method.

In one embodiment, the method includes one of a first channel or a second channel of a tongue with a first groove, the first groove being defined by a lower plate of a compression box of the rod forming apparatus, the tongue including, a major body, the major body having a first longitudinal length that runs from a first end to a second end of the major body, the major body including, the first channel defined along a first edge of the major body, the second channel defined along a second edge of the major body, the first channel and the second channel being hollow and running substantially along the first longitudinal length from the first end to the second end of the major body, the first channel and the second channel opposing each other and facing away from each other.

In one embodiment, the method further includes inserting the tongue into a hollow body of a tongue holder in a direction that is toward a first end of the tongue holder, until the tongue is wedged within the hollow body; attaching the tongue holder to an arm of a tongue support assembly; and using the tongue support assembly to align one of the first channel or the second channel with the first groove, and wherein the hollow body includes ribs that oppose each other, the ribs converging towards each other from a second end to the first end of the hollow body, a first sidewall and a second sidewall of the tongue both converging towards each other along the first longitudinal length of the major body so that the first sidewall and the second sidewall are conformed to a shape of the ribs to allow the tongue to be wedged within the hollow body.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
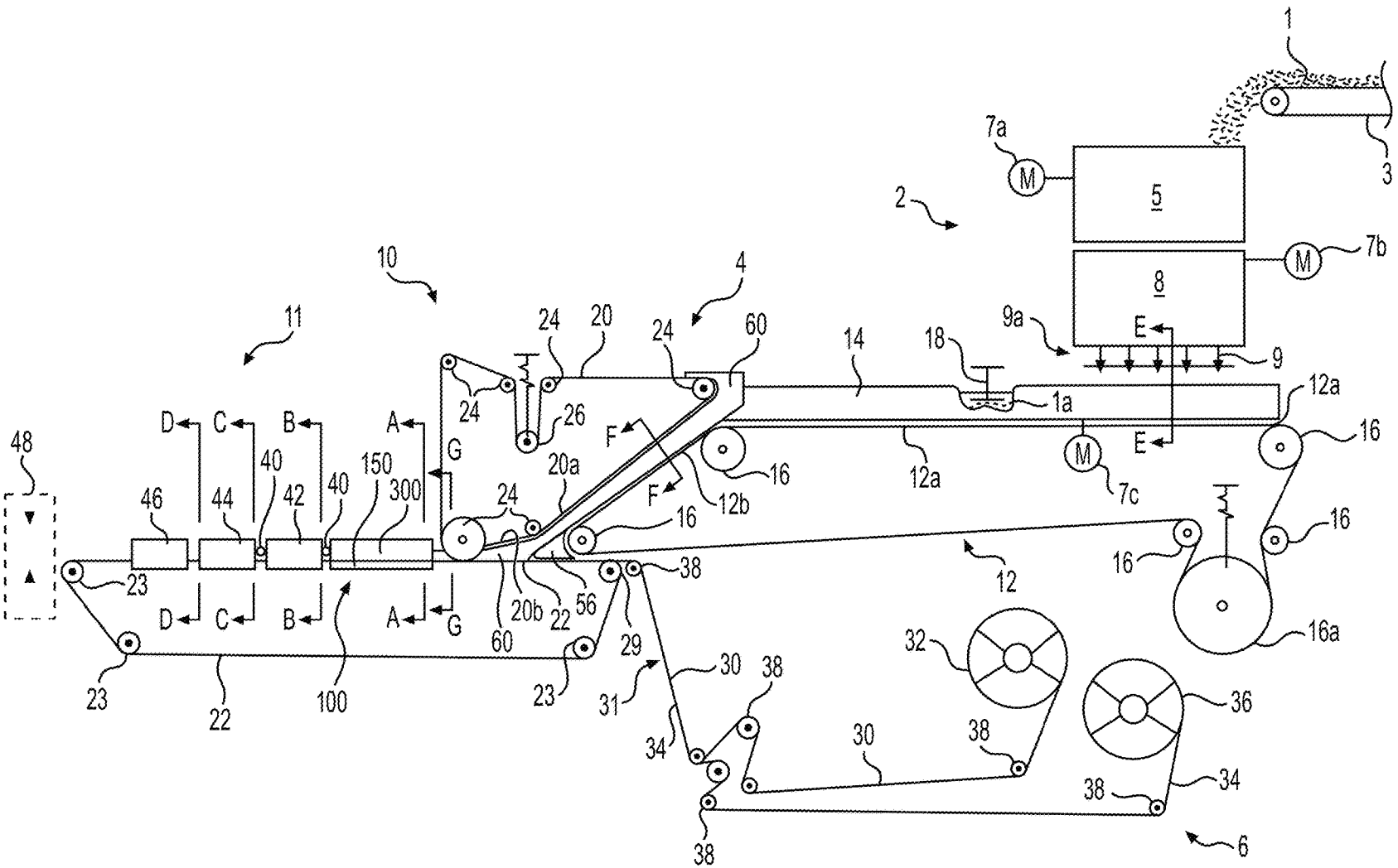
FIG. 1 is an illustration of a rod forming apparatus, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used, specify the presence of stated features, integers, steps, operations, and/or elements, but do not preclude the presence or addition of one or more other features, integers, steps, operations, elements, and/or groups thereof.

When the words "about" and "substantially" are used in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a rod forming apparatus 10, in accordance with an example embodiment. In an example embodiment, the rod forming apparatus 10 is used for the formation of a consumer product 600 (see FIG. 15). In an example embodiment, the consumer product 600 is a rolled product. In an example embodiment, the consumer product 600 is a rolled tobacco product, such as a tobacco rod. In an example embodiment, the tobacco rod is a cigar, a cigarette, or both a cigar and a cigarette.

In an example embodiment, the rod forming apparatus 10 includes a feed section 2, an in-feed section 4, a web section 6 and a finishing section 11. In an example embodiment, the feed section 2 includes at least one conveyor 3 for receiving tobacco 1 from a tobacco source (not shown). In an example embodiment, the tobacco 1 is shredded tobacco, as described in more detail herein. In an example embodiment, the feed section 2 includes a storage container 5 that may be at least one of a reservoir, a vat, a shipping container, etc. In an example embodiment, the rod forming apparatus 10 does not include the conveyor 3, as the tobacco 1 may be manually placed into the storage container 5, or the storage container 5 may be used until depleted and then replaced with another storage container 5.

In an example embodiment, the feed section 2 includes a feeder 8. The feeder 8 may be physically located below the storage container 5, and may receive tobacco 1 from the storage container 5. In an example embodiment, the feed section 2 does not include a storage container 5, and instead includes the feeder 8 and/or the conveyor 3. In an example embodiment, the storage container 5 and the feeder 8 are one integral element. Other configurations of the feed section 2 are contemplated.

In an example embodiment, the feeder 8 includes one or more outlets 9 at a lower portion of the feeder 8. In an example embodiment, the one or more outlets 9 are distributed in an outlet array 9*a*. In an example embodiment, the feeder 8 is a vibratory waterfall type feeder. In an example embodiment, the storage container 5, or the feeder 8, or both the storage container 5 and the feeder 8 include at least one electromagnetic (motorized) vibrator 7*a*/7*b* for causing the tobacco 1 to vibrate and uniformly settle, as the tobacco 1 leaves the storage container 5 and/or the feeder 8.

Figure 2:
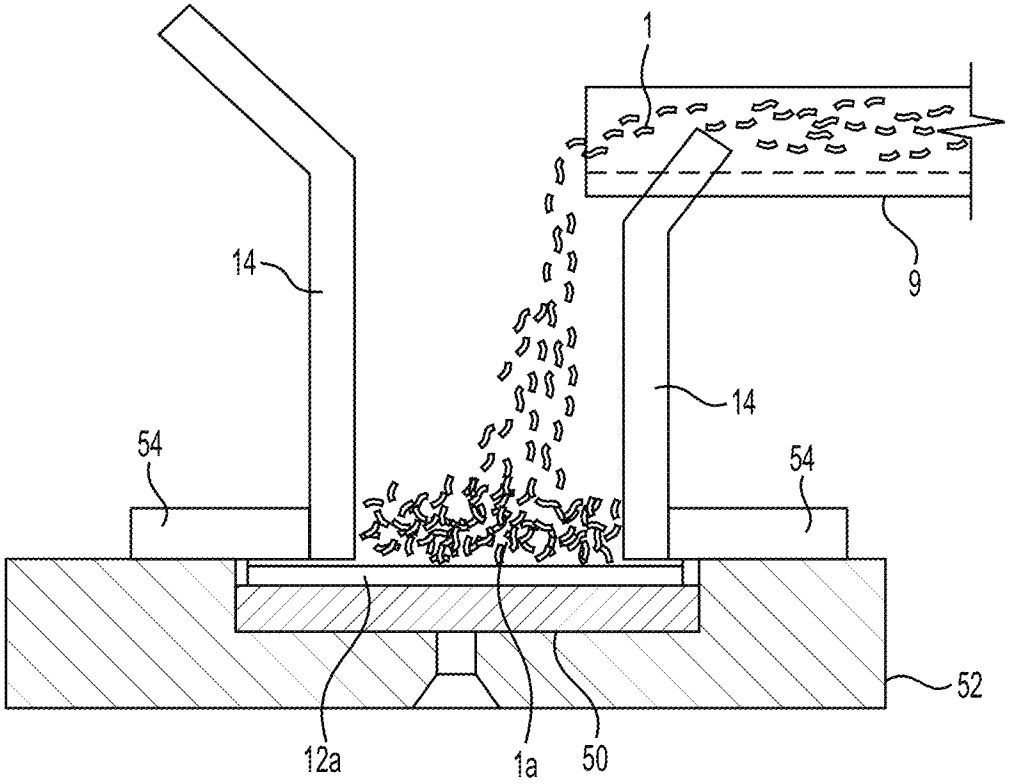
FIG. 2 is an illustration of a cross-sectional view of a portion of a feed section of FIG. 1, in accordance with an example embodiment.

In an example embodiment, the feeder 8 and/or the outlets 9 are capable of distributing the tobacco 1 onto an upper (conveyor) belt 12, as shown in better detail in FIG. 2. In an example embodiment, a first belt section 12*a* of the upper belt 12 is at least partially enclosed by a trough 14. The upper belt 12 may include rollers 16 capable of causing the upper belt 12 to move and transport the tobacco 1. In an example embodiment, the upper belt 12 includes a tensioning (biased) roller 16*a* that adjusts a tension of the upper belt 12. In an example embodiment, a trimmer unit 18 is included along the first belt section 12*a* so that a tobacco column 1*a* traveling along the first belt section 12*a* may be formed into a column with a desired and uniform height. In an example embodiment, the first belt section 12*a* includes at least one electromagnetic vibrator 7*c* to further ensure an evenly distributed tobacco column 1*a* that is spread across the first belt section 12*a*, as the tobacco column 1*a* rides along the first belt section 12*a*.

In an example embodiment, the feed section 2 and upper belt 12 provide the tobacco column 1*a* to the in-feed section 4 of the roll forming apparatus 10. In an example embodiment, the tobacco column 1*a* is transferred into the in-feed section 4 by a second belt section 12*b* of the upper belt 12 and an in-feed (compression) belt 20 that are downstream of the feeder 8. Specifically, in an example embodiment, the tobacco column 1*a* rides on the second belt section 12*b* (shown in better detail FIG. 3), while a descending belt section 20*a* of the in-feed belt 20 is in contact with a top portion of the tobacco column 1*a*. In an example embodiment, the in-feed belt 20 can be considered a compression belt, from the standpoint that the in-feed belt 20 helps assist in gently compressing the tobacco column 1*a*, as explained herein in more detail (see FIG. 3 in particular). In an example embodiment, the in-feed belt 20 travels along rollers 24. In an example embodiment, a tensioning roller 26 is included in the in-feed section 4 to adjust a tension of the in-feed belt 20.

In an example embodiment, the second belt section 12*b* and/or the descending belt section 20*a* feed the tobacco column 1*a* into the finishing section 11 of the rod forming apparatus 10. In an example embodiment, the second belt section 12*b* and/or the descending belt section 20*a* feed the tobacco column 1*a* to a lower belt 22. In an example embodiment, the lower belt 22 is a garniture belt, or a garniture tube belt. In an example embodiment, the lower belt 22 travels along a set of rollers 23.

In an example embodiment, the tobacco column 1*a* enters the finishing section 11 through a channel 21. In an example embodiment, the channel 21 has a continually and linearly decreasing cross-sectional area, as described in detail in association with FIGS. 3-7. In an example embodiment, the channel 21 is at least partially defined by a first squeeze bar 60 and a second squeeze bar 62 (see FIGS. 1, and 5-7), the descending belt section 20*a* of the in-feed belt 20 (see FIGS. 1 and 3-6), the second belt section 12*b* (see FIGS. 1 and 3-6) and the lower belt 22 (see FIGS. 1, 3 and 7). In an example embodiment, the first squeeze bar 60 and the second squeeze bar 62 hold the tobacco column 1*a* between the descending belt section 20*a* and the second belt section 12*b*, as the tobacco column 1*a* descends down to the lower belt 22, and the first squeeze bar 60 and the second squeeze bar 62 hold the tobacco column 1*a* between a horizontal belt section 20*b* of the in-feed belt 20 and the lower belt 22, as the tobacco column 1*a* is transported to a compression box 100 of the finishing section 11. In an example embodiment, the continually decreasing cross-sectional area of the channel 21 forces the tobacco column 1*a* to become compressed into an ever-smaller cross-section, until the tobacco column 1*a* reaches a desired cross-sectional dimension that enters the compression box 100.

In an example embodiment, the rod forming apparatus 10 includes the web section 6, where the web section 6 provides at least one covering 31 that may be applied longitudinally around the consumer product 600. In an example embodiment, the at least one covering 31 includes at least two web layers. In an example embodiment, the at least one covering 31 includes a binder web 30 and a wrapper web 34. In an example embodiment, the binder web 30 is used to bind the tobacco 1, and in doing so, the binder web 30 may come into intimate direct contact with the tobacco 1. In an example embodiment, the wrapper web 34 is used to cover the binder web 30. In an example embodiment, a bulk portion of the binder web 30 and the wrapper web 34 are respectively housed on a binder reel 32 and a wrapper reel 36. A series of rollers 38 may be used to guide the binder web 30 and the wrapper web 34 into the finishing section 11. In an example embodiment, the binder web 30 and the wrapper web 34 are formed from tobacco, tobacco pulp, compressed tobacco, or a derivative or extract of tobacco, where the binder web 30 and the wrapper web 34 are in the form of flatten sheets or ribbons.

Figure 14A:
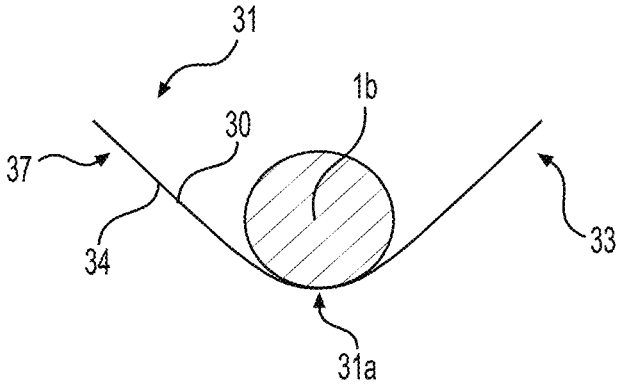
FIG. 14A is an illustration of a cross-sectional view a tobacco rod being bound, in accordance with an example embodiment.

In an example embodiment, once the tobacco column 1*a* and the at least one covering 31 proceed into the finishing (rod forming) section 11, via the force of the lower belt 22, the tobacco column 1*a* is guided through the compression box 100 to form a tobacco rod 1*b* (see at least FIG. 14A, which is view A-A of FIG. 1). In an example embodiment, the compression box 100 includes a tongue 300 (see at least FIGS. 9A-9G), that is mounted on a lower plate 150 (see at least FIG. 12A), where the compression box 100 assists in folding the at least one covering 31 longitudinally around at least a portion of the tobacco rod 1*b* (see FIG. 14B). In an example embodiment, the tobacco rod 1*b* and the at least one covering 31 pass through the compression box 100, prior to coming into contact with an adhesive applicator 40 and/or a short folder 42. In an example embodiment, the adhesive applicator 40 applies an adhesive 35 to a free edge 37 of the at least one covering 31 (see FIG. 14B, which is view B-B of FIG. 1), while the at least one covering 31 is partially wrapped around the tobacco rod 1*b*, as explained in more detail herein. In an example embodiment, the adhesive applicator 40 is a glue gun, or another device capable of discharging and applying the adhesive 35 to a sheet of material such as the at least one covering 31. In an example embodiment, the adhesive 35 is a food-safe organic fixative. In an example embodiment, the adhesive 35 is made from plant extract, starch, dextrin, other food-safe adhesives, or combinations thereof.

Figure 12A:
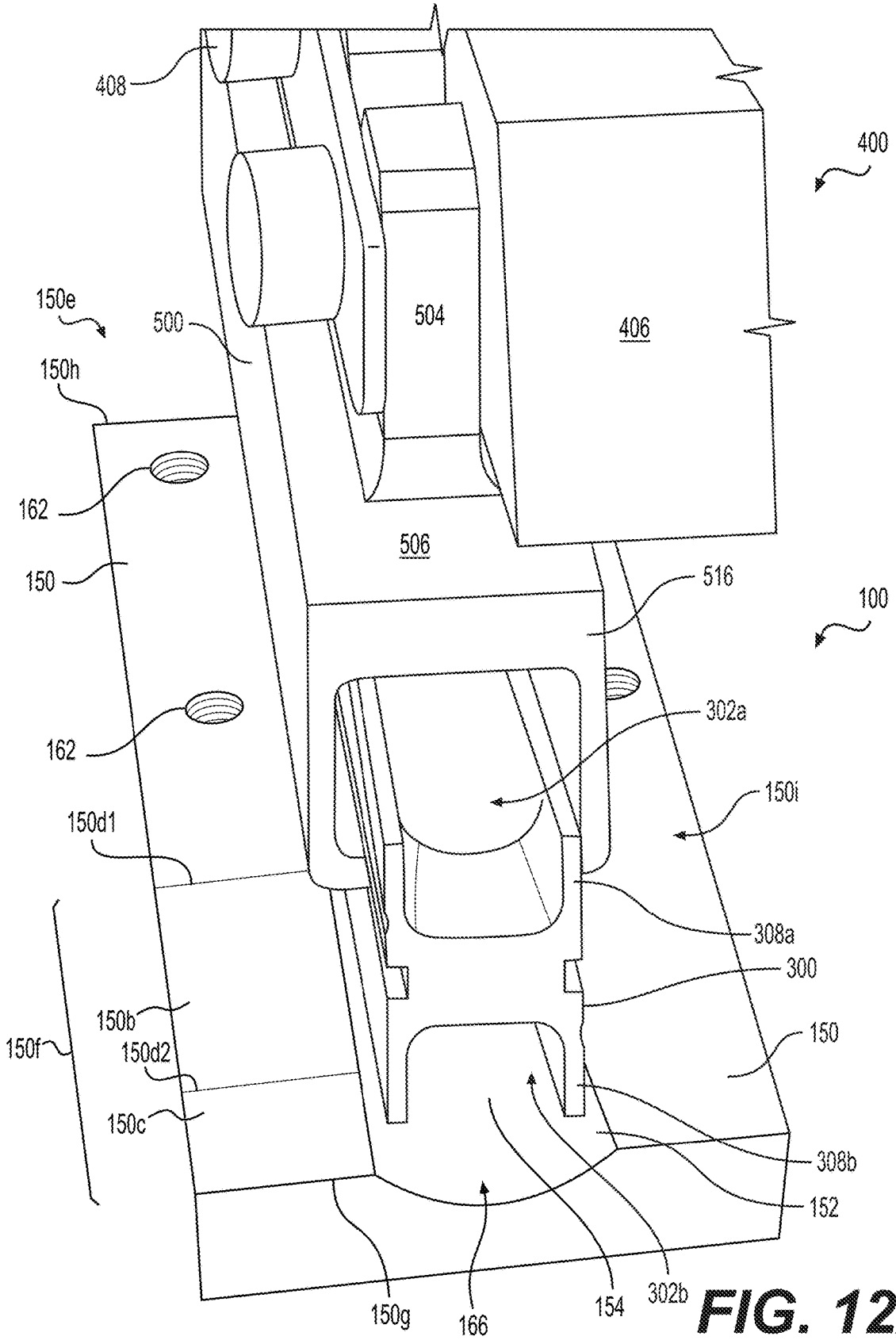
FIG. 12A is an illustration of a perspective view of the compression box, in accordance with an example embodiment.
Figure 12B:
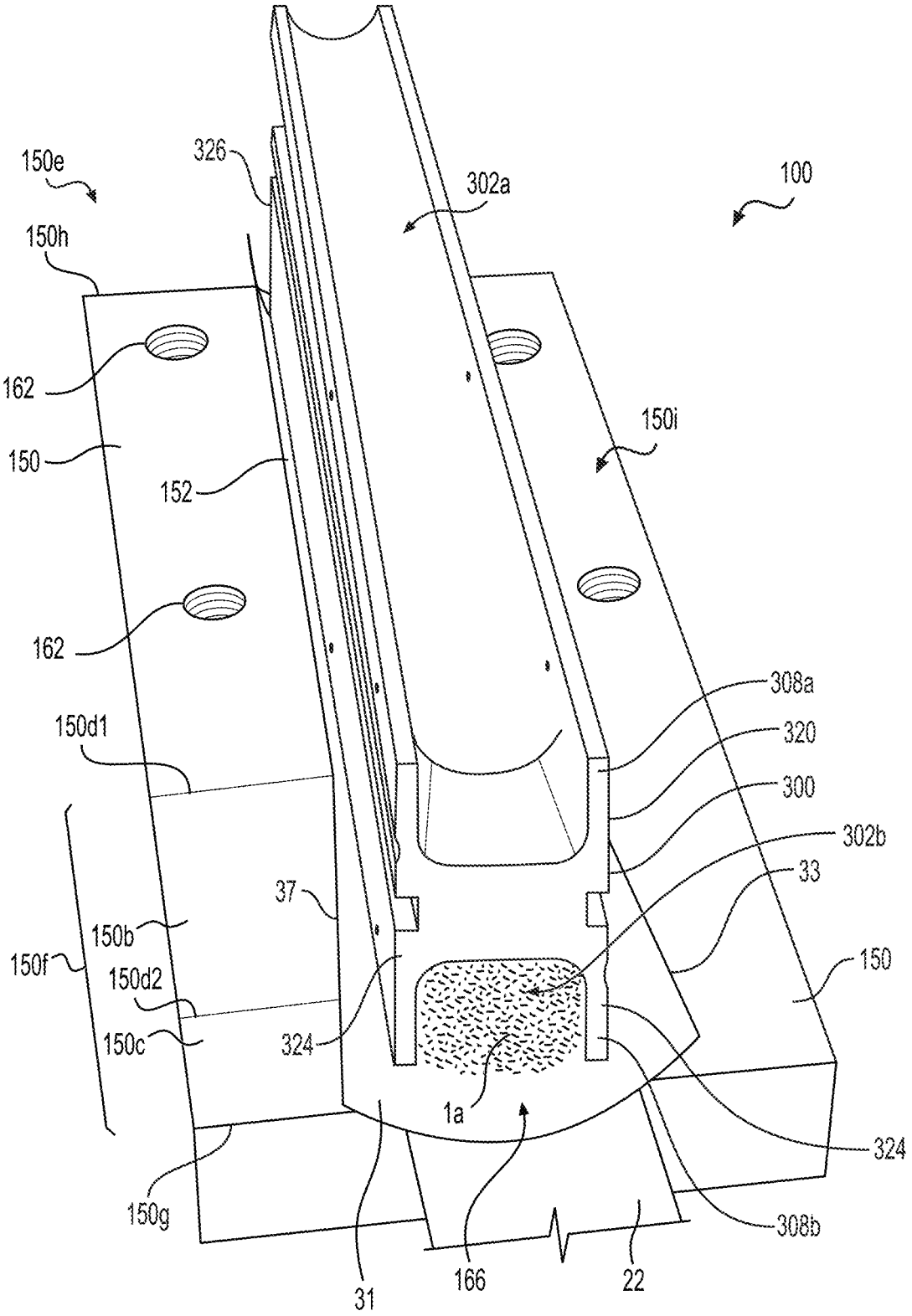
FIG. 12B is an illustration of a perspective view of the compression box, with the lower belt, the tobacco and the at least one covering shown passing through the compression box, in accordance with an example embodiment.
Figure 14B:
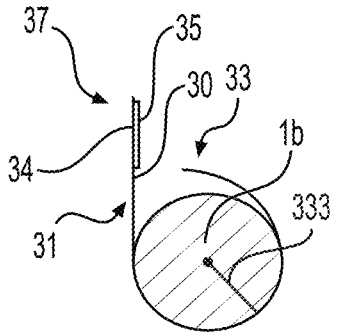
FIG. 14B is another illustration of a cross-sectional view the tobacco rod being bound, in accordance with an example embodiment.
Figure 14C:
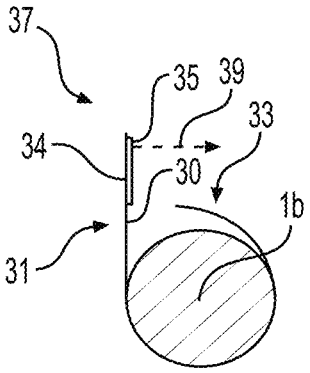
FIG. 14C is another illustration of a cross-sectional view the tobacco rod being bound, in accordance with an example embodiment.
Figure 14D:
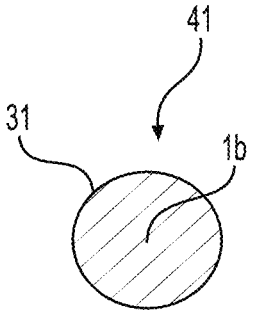
FIG. 14D is another illustration of a cross-sectional view the tobacco rod being bound, in accordance with an example embodiment.

In an example embodiment, the lower belt 22 causes the at least one covering 31 and the tobacco column 1*a* to travel in unison through the compression box 100 to the short folder 42, as discussed in more detail herein (see at least FIG. 12B). In an example embodiment, the short folder 42 folds a lap (folded) edge 33 of the at least one covering 31 toward the tobacco rod 1*b*, as shown in FIG. 14B (which is view B-B of FIG. 1). In an example embodiment, the adhesive applicator 40 can located before or after the short folder 42, as depicted in FIG. 1. In an example embodiment, the lower belt 22 causes the at least one covering 31 and the tobacco column 1*a* to then continue to travel through a finishing folder 44 and a heater 46. In an example embodiment, the short folder 42 and/or the finishing folder 44 causes the lap edge 33 of the at least one covering 31 to be pinned down on the tobacco rod 1*b*, while the free edge 37 of the at least one covering 31 is also folded (in direction 39, as shown in FIG. 14C) toward the tobacco rod 1*b* and the lap edge 33 (see FIG. 14C, which is view C-C of FIG. 1). In an example embodiment, the heater 46 applies heat to the at least one covering 31 and the tobacco rod 1*b* to set the adhesive 35. In an example embodiment, following the heater 46, the at least one covering 31 is fused onto the tobacco rod 1*b* (as shown in FIG. 14D, which is view D-D of FIG. 1) to form a finished rod 41.

Figure 15:
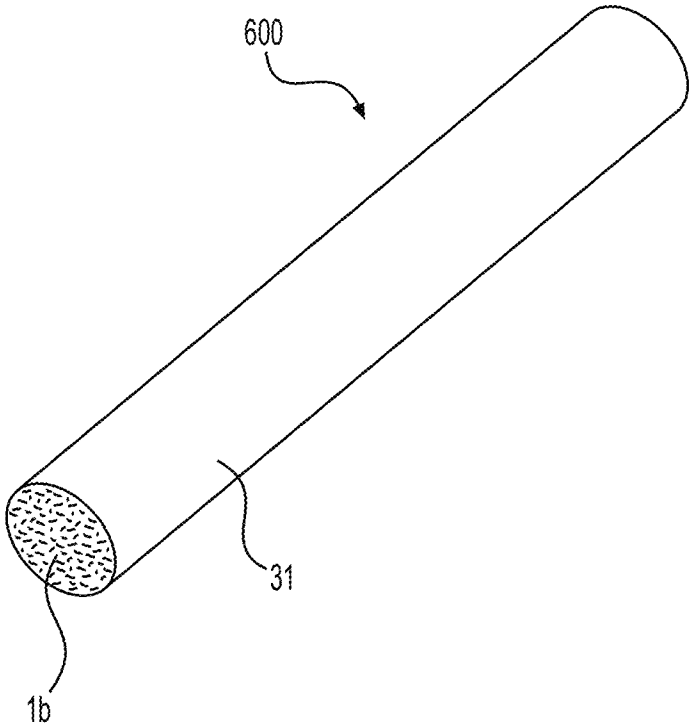
FIG. 15 is an illustration of a consumer product that is made from the rod forming apparatus, in accordance with an example embodiment.

In an example embodiment, the lower belt 22 causes the finished rod 41 to pass through a cutter 48. In an example embodiment, the cutter 48 cuts the finished rod 41 into segments, where these segments form the consumer product 600 (FIG. 15).

FIG. 2 is an illustration of a cross-sectional view of a portion of the feed section 2 of FIG. 1 (from the perspective of view E-E of FIG. 1), in accordance with an example embodiment. In an example embodiment, the first belt section 12*a* of the upper belt 12 rides above a conveyor guide 50. In an example embodiment, the conveyor guide 50 is positioned within a conveyor base plate 52. In an example embodiment, tobacco 1 from the feed section 2 is deposited upon the first belt section 12*a* to form a tobacco column 1*a*. In an example embodiment, the trough 14 keeps the tobacco column 1*a* on the first belt section 12*a* as the tobacco column 1*a* is conveyed to the in-feed section 4 of the rod forming apparatus 10. In an example embodiment, the trough 14 is stabilized and/or mounted onto the conveyor base plate 52 by one or more brackets 54.

Figure 3:
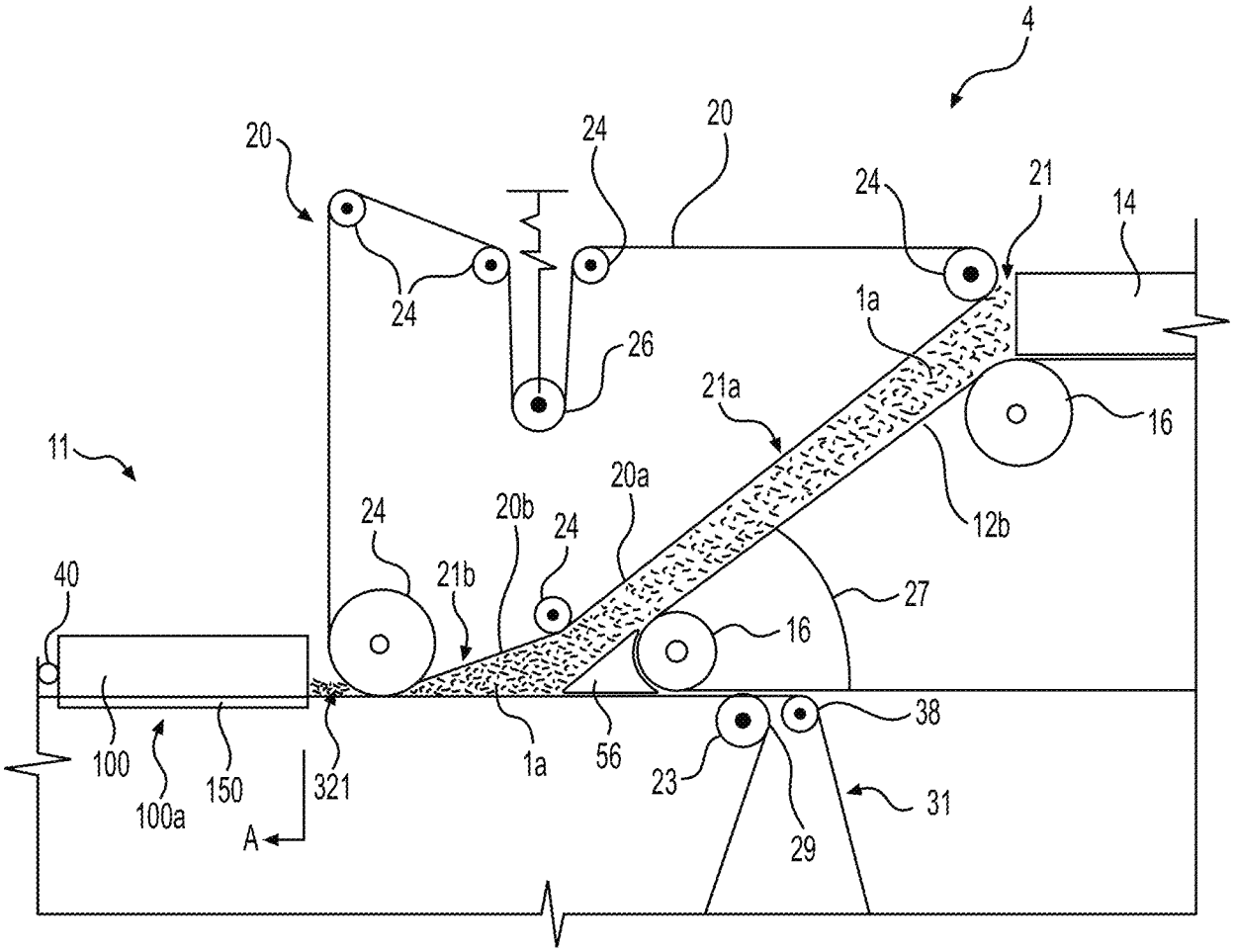
FIG. 3 is an illustration of an enlarged view of an in-feed section and a finishing section of the rod forming apparatus, in accordance with an example embodiment.
Figure 4:
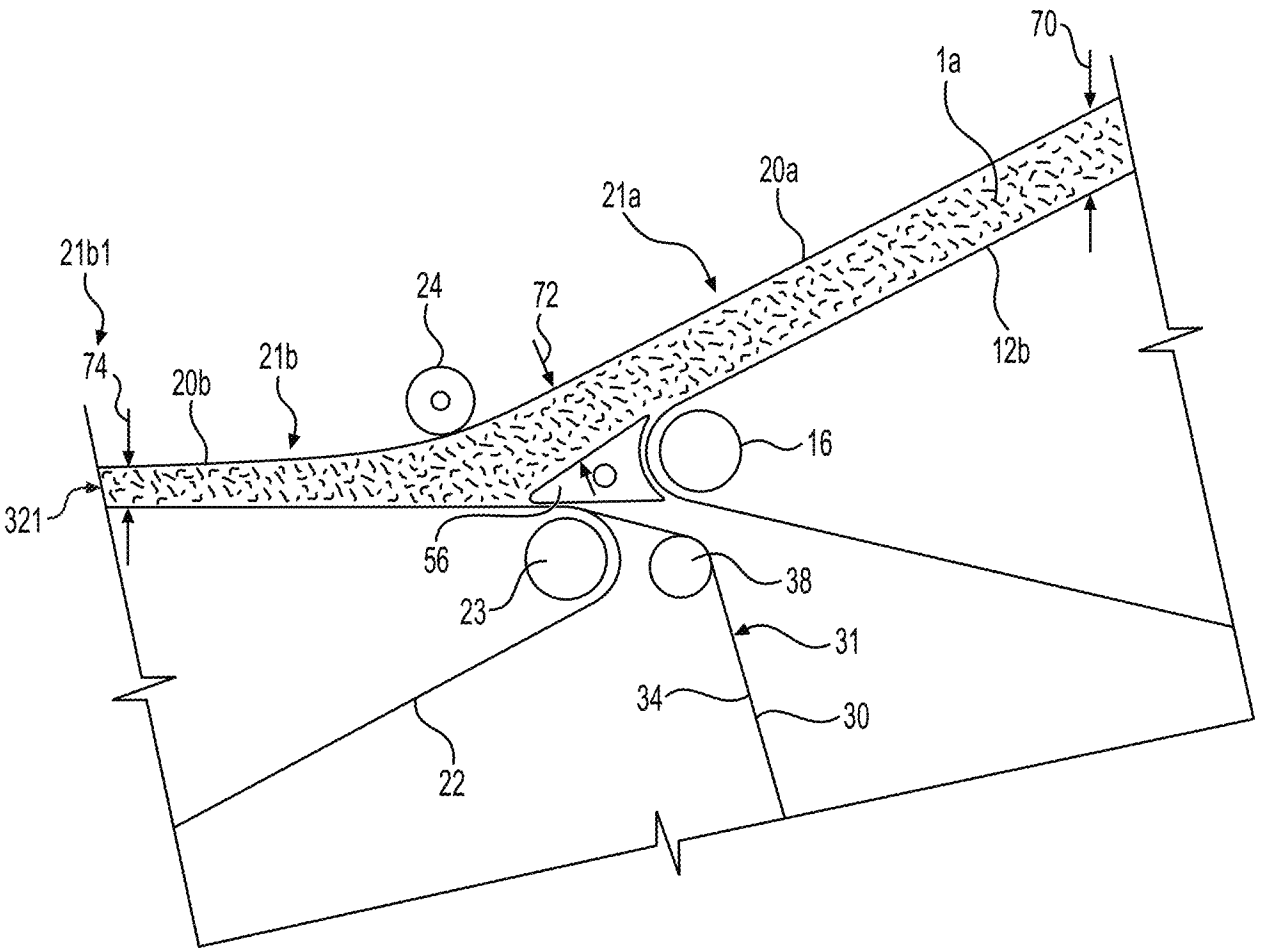
FIG. 4 is an illustration of a portion of the in-feed section of the rod forming apparatus, in accordance with an example embodiment.
Figure 5:
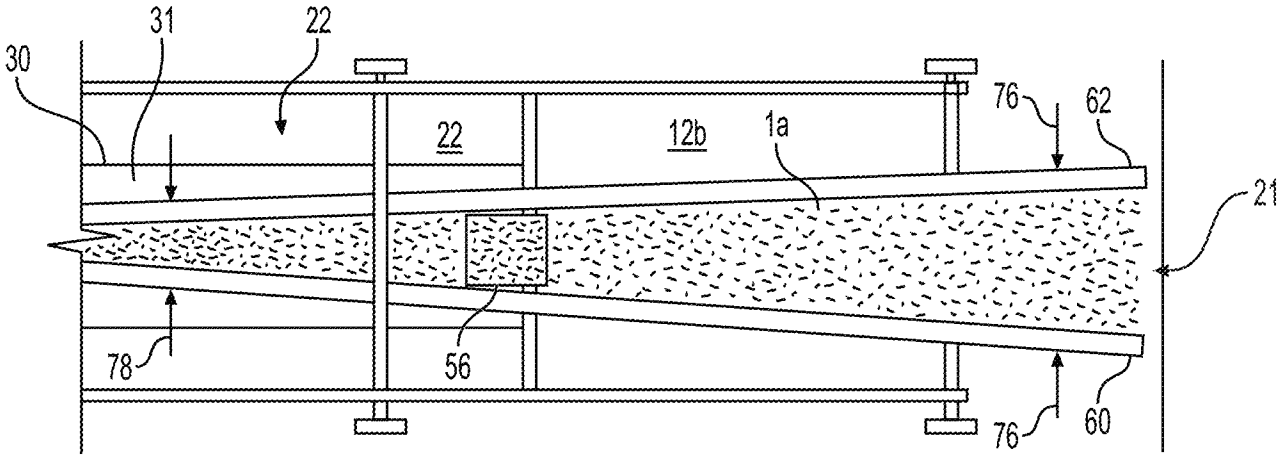
FIG. 5 is an illustration of a top view of a portion of the in-feed section of the rod forming apparatus, in accordance with an example embodiment.

FIG. 3 is an illustration of an enlarged view of the in-feed section 4 and a portion of the finishing section 11 of the rod forming apparatus 10 of FIG. 1, in accordance with an example embodiment. In FIG. 3, the in-feed section 4 is shown without the first squeeze bar 60 in position on a side of the channel (in-feed flow path) 21, in order to better understand the in-feed section 4, though it should be understood that the first squeeze bar 60 is normally installed in front of the channel 21 during normal operational use of the rod forming apparatus 10. In an example embodiment, a descending section 21*a* of the channel 21 is defined at least in part by the second belt section 12*b*, the descending belt section 20*a*, the first squeeze bar 60 and a second squeeze bar 62 (also see FIGS. 1, 4 and 6). In an example embodiment, the tobacco column 1*a* rides primarily along the second belt section 12*b*, where the descending belt section 20*a* of the in-feed belt 20 also assists in the transport of the tobacco column 1*a* through the descending section 21*a* of the channel 21. In an example embodiment, the descending section 21*a* of the channel 21 has a continually narrowing cross-sectional flow area, as the tobacco column 1*a* descends down to a horizontal section 21*b* of the channel 21, as also depicted in FIGS. 4 and 5. The continually narrowing cross-sectional flow area of the descending section 21*a* of the channel 21 causes the tobacco column 1*a* to be gently and continually compressed.

In an example embodiment, a decline angle 27 of the descending section 21*a* of the channel 21 (defined by the second belt section 12*b* and the descending belt section 20*a*), assists in driving the tobacco column 1*a* through the channel 21 with enough velocity that the tobacco column 1*a* has a necessary momentum to flow through the horizontal section

21*b* of the channel 21 and the compression box 100, where the tobacco column 1*a* is further compressed along the way. To that end, if the decline angle 27 is exceedingly steep, this may cause the tobacco column 1*a* to flow at too great of a velocity, causing a potential over-compression of the tobacco column 1*a* (and, subsequent potential "accordion effect," caused by the over-compression), due to any minor disruption or impedance of the flow of the tobacco column 1*a* through the rod forming apparatus 10. An exceedingly mild decline angle 27 can leave the tobacco column 1*a* without enough velocity and momentum to carry the tobacco column 1*a* through the channel 21 and the compression box 100. Therefore, in an example embodiment, the decline angle 27 is about 10-45 degrees (relative to a horizontal plane, where the horizontal plane is perpendicular to gravity). It should be understood that the decline angle 27 varies, depending for instance on a speed of the second belt section 12*b* and the descending belt section 20*a*, and a composition of the tobacco column 1*a*.

In an example embodiment, the channel 21 is also at least partially defined by the horizontal section 21*b*, where the horizontal section 21*b* feeds the tobacco column 1*a* into the compression box 100. In an example embodiment, the horizontal section 21*b* also has a continually narrowing cross-sectional flow area that causes the tobacco column 1*a* to be further compressed prior to flowing into the compression box 100. In an example embodiment, the horizontal section 21*b* of the channel 21 is defined at least in part by the lower belt 22, the horizontal belt section 20*b*, and horizontal portions 84 of the first squeeze bar 60 and the second squeeze bar 62 (see FIGS. 8A-8D).

In an example embodiment, the in-feed section 4 includes a transition piece 56 that further defines the channel 21. Specifically, in an example embodiment, the transition piece 56 fills a gap (bridges a transition) between the second belt section 12*b* and the lower belt 22, allowing the tobacco column 1*a* to more smoothly flow over the transition piece 56 as the tobacco column 1*a* leaves the second belt section 12*b* and flows onto the lower belt 22. In an example embodiment, the transition piece 56 may serve to reduce a level of turbulence that might otherwise be imparted to the tobacco column 1*a* traversing between the second belt section 12*b* and the lower belt 22. Specifically, in an example embodiment, the transition piece 56 occupies a space at the transition between the upper belt 12 and the lower belt 22, where this space would otherwise allow the tobacco column 1*a* to potentially accumulate and intermittently release, which may impact a consistency of the final consumer product 600.

FIG. 4 is an illustration of a portion of the in-feed section 4 of the rod forming apparatus 10, in accordance with an example embodiment. This view depicts a flow of the tobacco column 1*a*, through a section of the descending section 21*a* and a section of the horizontal section 21*b* of the channel 21. In an example embodiment, the at least one covering 31 is pulled underneath and past the transition piece 56, as the tobacco column 1*a* flows over the transition piece 56 and over a portion of the at least one covering 31 that is directly on the lower belt 22. In an example embodiment, the depth of the tobacco column 1*a* is continually reduced, as the cross-sectional flow area of the channel 21 continues to narrow along a length of the channel 21. Specifically, in an example embodiment, an initial depth 70 of the tobacco column 1*a*, which is defined by a distance between the second belt section 12*b* and the descending belt section 20*a* toward a beginning of the descending section 21*a* of the channel 21, is reduced down to a smaller depth 72 (adjacent to the transition piece 56) as a distance between the second belt section 12*b* and the descending belt section 20*a* continually narrows along the descending section 21*a* of the channel 21. The depth 74 of the tobacco column 1*a* is even further reduced, due to an even smaller gap between the horizontal belt section 20*b* and the lower belt 22, as the tobacco column 1*a* flows through an end of the horizontal section 21*b* of the channel 21 just prior to the tobacco column 1*a* being discharged into the compression box 100.

In an example embodiment, a speed of travel of the upper belt 12 matches a speed of travel of the in-feed belt 20. In an example embodiment, a speed of travel of the lower belt 22 matches the speed of travel of the upper belt 12 and the in-feed belt 20.

FIG. 5 is an illustration of a top (cut-away) view of a portion of the in-feed section 4 of the rod forming apparatus 10, in accordance with an example embodiment. In this top view, a relationship is depicted between the first squeeze bar 60, the second squeeze bar 62, the second belt section 12*b* and the lower belt 22. In an example embodiment, an initial width 76 between the first squeeze bar 60 and the second squeeze bar (near a proximal end of the squeeze bars 60/62) is narrowed to a smaller width 78 (near a distal end of the squeeze bars 60/62). In an example embodiment, the squeeze bars 60/62 are positioned so that the width between the squeeze bars 60/62 is continually decreasing, just as a depth of the tobacco column 1*a* (from the initial depth 70, to depth 74, shown in FIG. 4) is continually decreasing. This causes the tobacco column 1*a* to gradually and continually become compressed, as the tobacco column 1*a* flows through the descending section 21*a* and the horizontal section 21*b* of the channel 21 (also see FIG. 4).

In an example embodiment, the at least one covering 31 comes into intimate direct contact with the tobacco column 1*a*, as the at least one covering 31 moves under and past the transition piece 56 and the tobacco column 1*a* moves over and past the transition piece 56. In an example embodiment, the lower belt 22 is directly below the at least one covering 31 (obscured from view in FIG. 5), where the lower belt 22 also passes under the transition piece 56.

Figure 6:
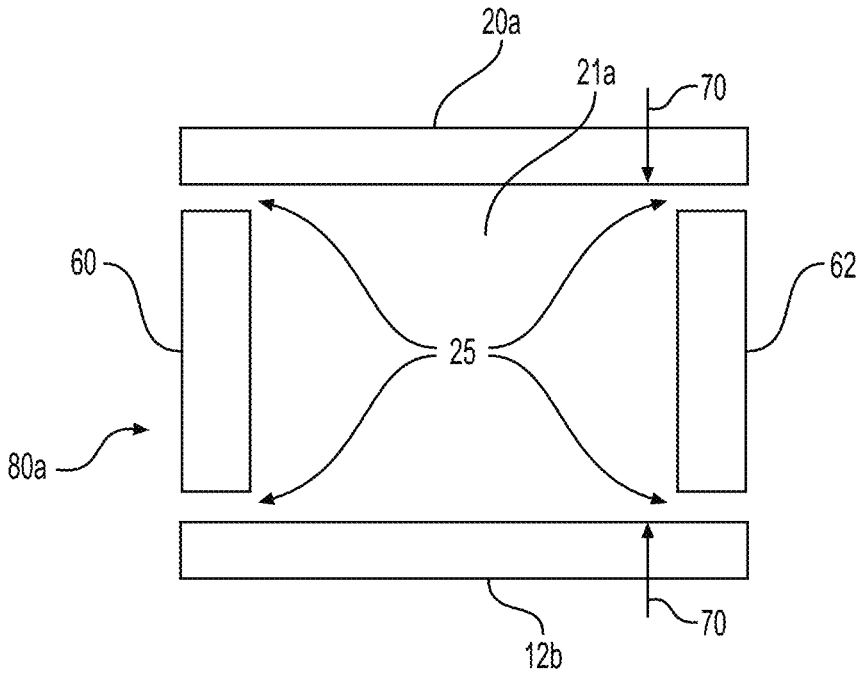
FIG. 6 is an illustration of a channel of the in-feed section of the rod forming apparatus, in accordance with an example embodiment.

FIG. 6 is an illustration of a cross-sectional view (view F-F of FIG. 1) of the descending section 21*a* of the channel 21 of the in-feed section 4 of the rod forming apparatus 10, in accordance with an example embodiment. Specifically, this view is toward a proximal end 80*a* of a main shaft 80 of the squeeze bars 60/62 (see at least FIG. 8B). In an example embodiment, and at this location of the descending section 21*a* of the channel 21 (see FIGS. 3 and 4), a depth 70 of the tobacco column 1*a* is relatively large due to a large gap between the second belt section 12*b* and the descending belt section 20*a*, and the squeeze bars 60/62 are relatively far apart from each other such that a major portion of the descending belt section 20*a* and a major portion of the second belt section 12*b* contact the tobacco column 1*a* thereby assisting the tobacco column 1*a* in being conveyed down to the horizontal section 21*b* of the channel 21. In an example embodiment, gaps 25 exist in the descending section 21*a* of the channel 21 to provide a small clearance to allow the descending belt section 20*a* and the second belt section 12*b* to move past the squeeze bars 60/62.

Figure 7:
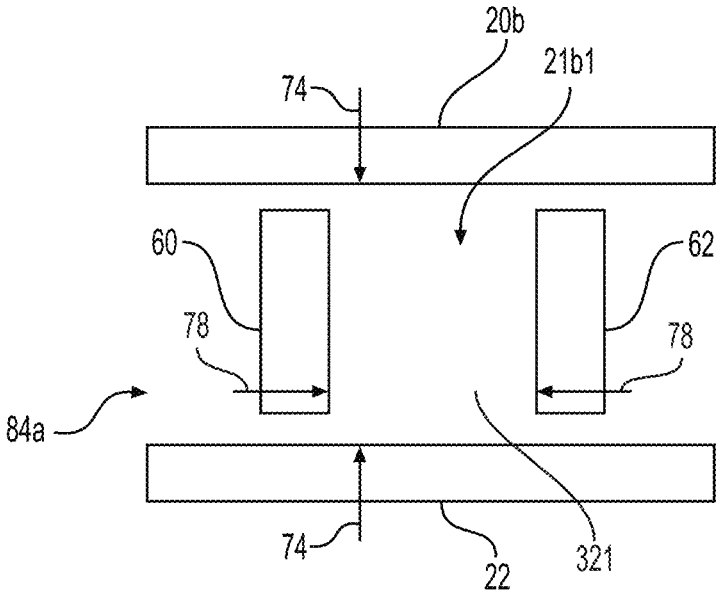
FIG. 7 is another illustration of the channel of the in-feed section of the rod forming apparatus, in accordance with an example embodiment.

FIG. 7 is another illustration of a cross-sectional view (view G-G of FIG. 1) of a distal end 21*b*1 of the horizontal section 21*b* of the channel 21 (FIG. 4) of the in-feed section 4 of the rod forming apparatus 10, in accordance with an example embodiment. This view corresponds to a discharge end 321 of the in-feed section 4 (e.g., also the discharge end 321 of the first squeeze bar 60 and the second squeeze bar 62). In an example embodiment, the discharge end 321 of the in-feed section 4 directly interfaces with the compression box 100 (see at least FIGS. 1 and 3). In an example embodiment, and at the discharge end 321, the squeeze bars 60/62 are relatively close together, thereby assisting in the compression of the tobacco column 1*a*, as the depth 74 of the tobacco column 1*a* is also depressed by the narrowing gap between the horizontal belt section 20*b* and the lower belt 22 (see FIG. 4). In an example embodiment, the gaps 25 exist in the horizontal section 21*b* of the channel 21 to provide a small clearance to allow the horizontal belt section 20*b* and the lower belt 22 to move past the squeeze bars 60/62.

Figure 8A:
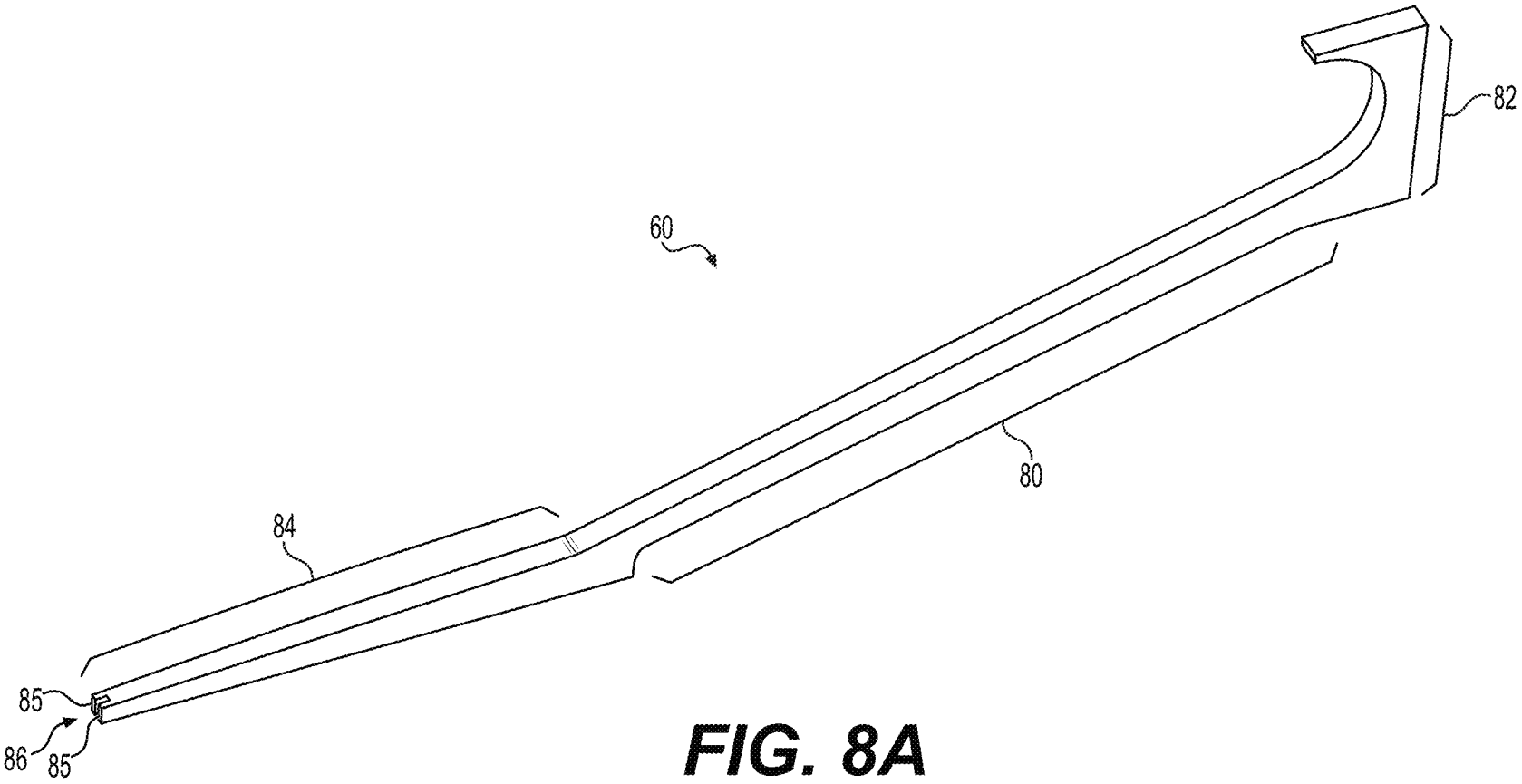
FIG. 8A is an illustration of a perspective view of a squeeze bar, in accordance with an example embodiment.

FIG. 8A is an illustration of a perspective view of the first (outer) squeeze bar 60, in accordance with an example embodiment. In an example embodiment, the first squeeze bar 60 includes a hook 82 on a proximal end of the first squeeze bar 60, and a horizontal portion 84 on a distal end of the first squeeze bar 60. In an example embodiment, the first squeeze bar 60 includes a main shaft 80 that slopes at an angle, between the hook 82 and the horizontal portion 84. In an example embodiment, a general shape of the first squeeze bar is conformed to a general shape of the channel 21, as shown in FIGS. 3 and 4.

In an example embodiment, the hook 82 can be a different shape than what is shown in FIG. 8A. In an example embodiment, the hook 82 is capable of fitting around, and being stabilized by a roller 24 (as shown in FIGS. 1 and 3). In an example embodiment, a tip 86 of the first squeeze bar 60 includes at least one protrusion (prong) 85 extending from the tip 86 (see also FIG. 8C).

Figure 8B:
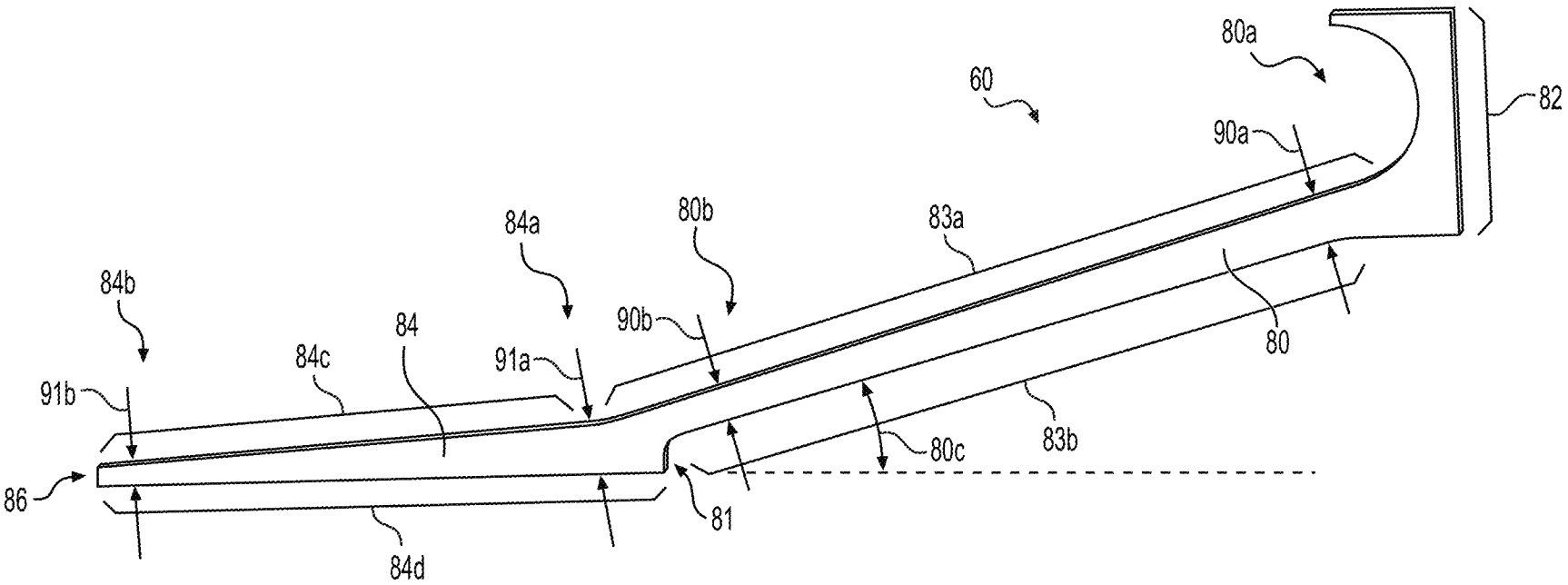
FIG. 8B is an illustration of a side view of the squeeze bar, in accordance with an example embodiment.

FIG. 8B is an illustration of a side view of the first squeeze bar 60, in accordance with an example embodiment. In an example embodiment, a depth 90*a* of the main shaft 80, at a proximal end 80*a* of the main shaft 80, is larger than a depth 90*b* of a distal end 80*b* of the main shaft 80. In an example embodiment, the depth of the main shaft 80 continues to decrease along a longitudinal length of the main shaft 80, from the proximal end 80*a* to the distal end 80*b*. In an example embodiment, a length of an upper surface 83*a* of the main shaft 80 is longer than a length of a lower surface 83*b* of the main shaft 80.

In an example embodiment, a depth 91*a* of the horizontal portion 84, at a proximal end 84*a* of the horizontal portion 84, is larger than a depth 91*b* of a distal end 84*b* of the horizontal portion 84. In an example embodiment, the depth of the horizontal portion 84 continues to decrease along a longitudinal length of the horizontal portion 84, from the proximal end 84*a* to the distal end 84*b*. In an example embodiment, a length of an upper surface 84*c* of the horizontal portion 84 is shorter than a length of a lower surface 84*d* of the horizontal portion 84. In an example embodiment, a step 81 divides the lower surface 84*d* of the horizontal portion 84 from the lower surface 83*b* of the main shaft 80. In an example embodiment, the lower surface 84*d* is substantially flat.

In an example embodiment, the main shaft 80 has an incline angle 80*c* that is about 10-45 degrees, relative to the lower surface 84*d* of the horizontal portion 84. In an example embodiment, the incline angle 80*c* matches the decline angle 27 the descending section 21*a* of the channel 21 (defined by the second belt section 12*b* and the descending belt section 20*a*, as shown in FIG. 3).

Figure 8C:
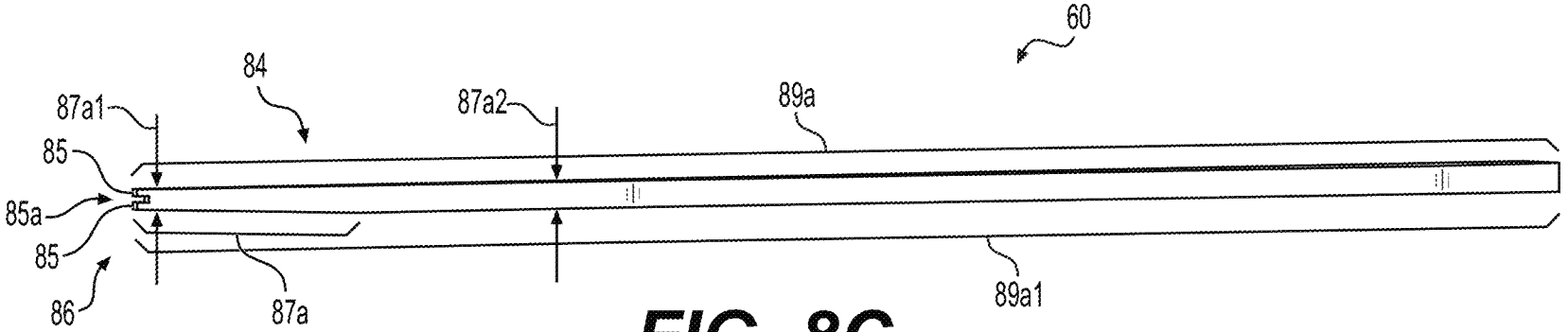
FIG. 8C is an illustration of a top view of the squeeze bar, in accordance with an example embodiment.

FIG. 8C is an illustration of a top view of the first squeeze bar 60, in accordance with an example embodiment. In an example embodiment, an inner surface 89*a* of the first squeeze bar 60 is substantially flat. In an example embodiment, an outer surface 89*a*1 is substantially flat, other than a distal end of the horizontal portion 84 that includes an angled offset 87*a*. In an example embodiment, a thickness 87*a*1 of the distal end of the horizontal portion 84 is smaller than a thickness 87*a*2 of the remainder of the first squeeze bar 60. In an example embodiment, the inner surface 89*a* of the first squeeze bar 60 contacts the tobacco column 1*a*, once the first squeeze bar 60 is installed on the rod forming apparatus 10.

In an example embodiment, the tip 86 on the distal end of the horizontal portion 84 includes two protrusions 85 that form a notch 85*a*. In an example embodiment, only one protrusion 85 exists on the distal end of the horizontal portion 84, where the protrusion 85 extends from the inner surface 89*a* of the first squeeze bar 60. In an example embodiment, the tip 86 does not include protrusions 85.

Figure 8D:
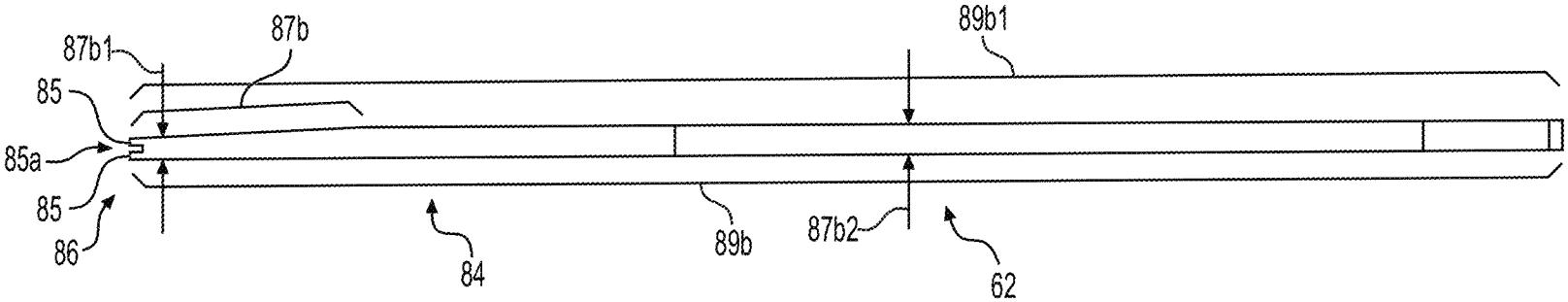
FIG. 8D is an illustration of a top view of another squeeze bar, in accordance with an example embodiment.

FIG. 8D is an illustration of a top view of the second squeeze bar 62, in accordance with an example embodiment. In an example embodiment, the second squeeze bar 62 is a mirror-image of the first squeeze bar 60. Therefore, in an example embodiment, an inner surface 89*b* of the second squeeze bar 62 is substantially flat. In an example embodiment, an outer surface 89*b*1 is substantially flat, other than a distal end of the horizontal portion 84 that includes an angled offset 87*b*. In an example embodiment, a thickness 87*b*1 of the distal end of the horizontal portion 84 is smaller than a thickness 87*b*2 of the remainder of the second squeeze bar 62. In an example embodiment, the inner surface 89*b* of the second squeeze bar 62 contacts the tobacco column 1*a*, once the second squeeze bar 62 is installed on the rod forming apparatus 10.

In an example embodiment, the second (inner) squeeze bar 62 opposes the first (outer) squeeze bar 60 in the rod forming apparatus 10, as shown in at least FIGS. 5-7.

Figure 9A:
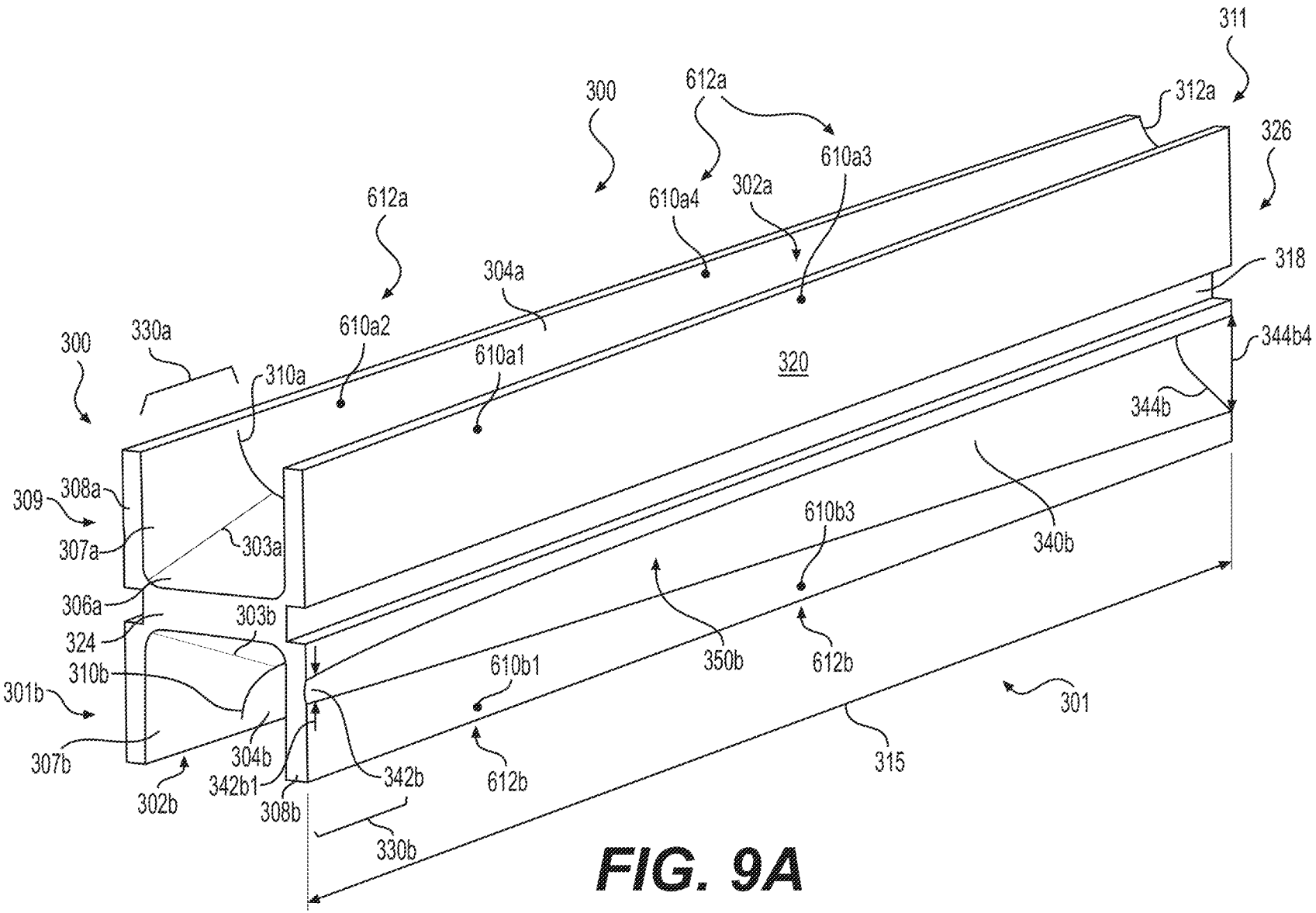
FIG. 9A is an illustration of a perspective view of a tongue, in accordance with an example embodiment.

FIG. 9A is an illustration of a perspective view of the tongue 300, in accordance with an example embodiment. In an example embodiment, the tongue 300 includes a major body 301. In an example embodiment, and as shown in FIG. 9A-9G, the major body 301 is substantially block shaped, with a substantially rectangular side profile (see for instance FIGS. 9E and 9F). In an example embodiment, the major body 301 is tapered on one end (see for instance an overhead view of the tongue 300, in FIG. 9G), such that a width thereof decreases from a first end 309 to a second end 311 of the major body 301 (also see FIG. 9G). In an example embodiment, the major body 301 has a uniform height (elevation), along a longitudinal length 315 of the major body 301. In an example embodiment, the major body 301 defines a first channel 302*a* along a top surface (first edge) of the major body 301. In an example embodiment, the major body 301 defines a second channel 302*b* along a lower surface (second edge) of the major body 301. In an example embodiment, the first channel 302*a* and the second channel 302*b* are hollow (in the shape of a half-pipe, with a semi-circular or U-shaped vertical cross-sectional profile), and run substantially along the longitudinal length 315 of the major body 301. In an example embodiment, the first channel 302*a* and the second channel 302*b* are defined to span from a first endwall 324 of the major body 301 to a second endwall 326 (see also FIG. 9B) of the major body 301. In an example embodiment, the first channel 302*a* and the second channel 302*b* oppose each other, and face away from each other (e.g., a first inner surface 304*a* of the first channel 302*a* faces away from a second inner surface 304*b* of the second channel 302*b*).

In an example embodiment, the longitudinal length 315 of the tongue 300 is relatively short. In an example embodiment, the longitudinal length 315 of the tongue 300 is about 115-160 mm, or about 127-137 mm, or about 132 mm, which makes the tongue 300 relatively short, for purposes of producing the consumer product 600 (FIG. 15), which is a rolled product. In this example embodiment, the reduced length of the tongue 300 provides a faster and more efficient shaping of the tobacco rod 1*b*, reduces an amount of lost tobacco 1, and reduces a potential for the tobacco rod 1*b* in the tongue 300 to experience the "accordion effect" that can be caused by void (or, uncompressed) areas of the tobacco rod 1*b* that can become compressed, or over-compressed, at high speeds as the tobacco rod 1*b* is forced through the tongue 300.

Figure 9B:
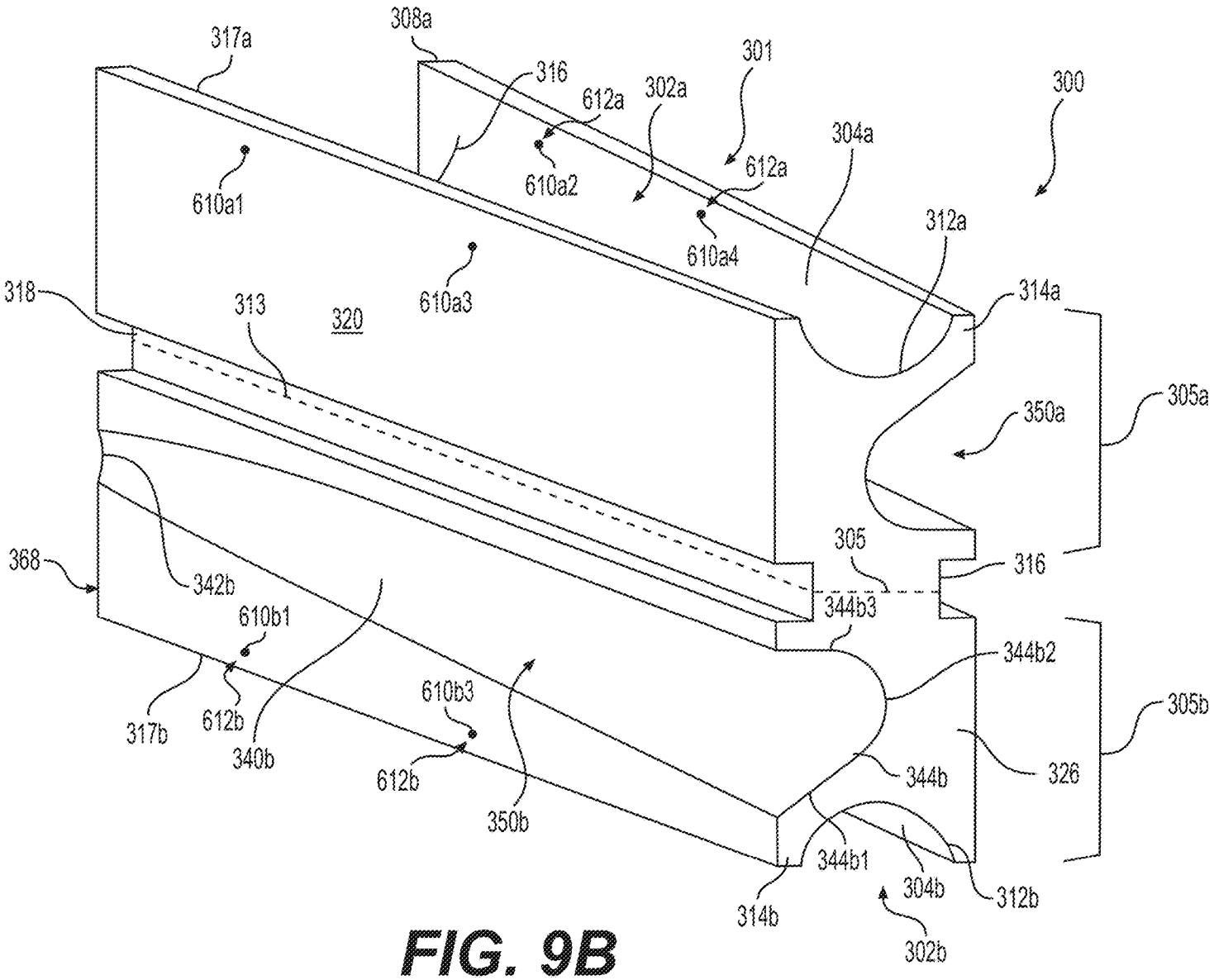
FIG. 9B is an illustration of another perspective view of the tongue, in accordance with an example embodiment.

In an example embodiment, the major body 301 includes a top half and a bottom half (e.g., first portion 305*a* is the top half, and second portion 305*b* is the bottom half, as shown in FIG. 9B), where both of these halves have physical characteristics that are identical. Therefore, throughout the remainder of this document, elements and physical characteristics of one portion (half) of the major body 301 are often described on the basis that the description applies equally to the other portion (half), and from that standpoint an identical reference numbering scheme has been adopted for each half of the major body 301. The nature of the identical characteristics of the two halves of the major body 301 are further elaborated, in detail, herein.

Figure 9D:
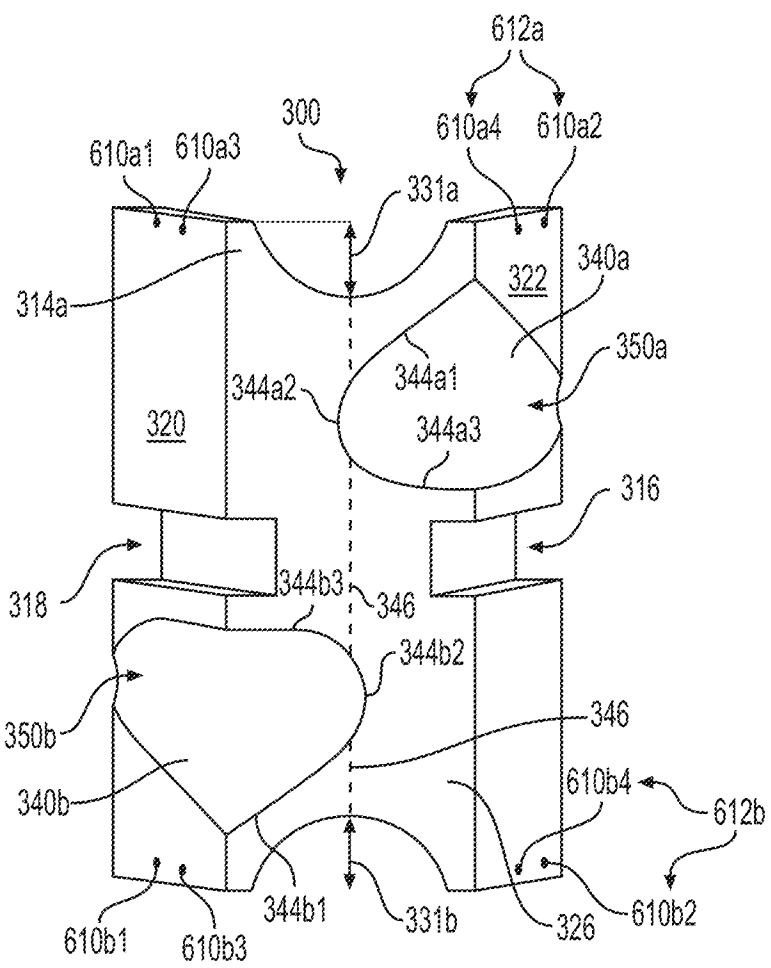
FIG. 9D is an illustration of a rear view of the tongue, in accordance with an example embodiment.
Figure 9C:
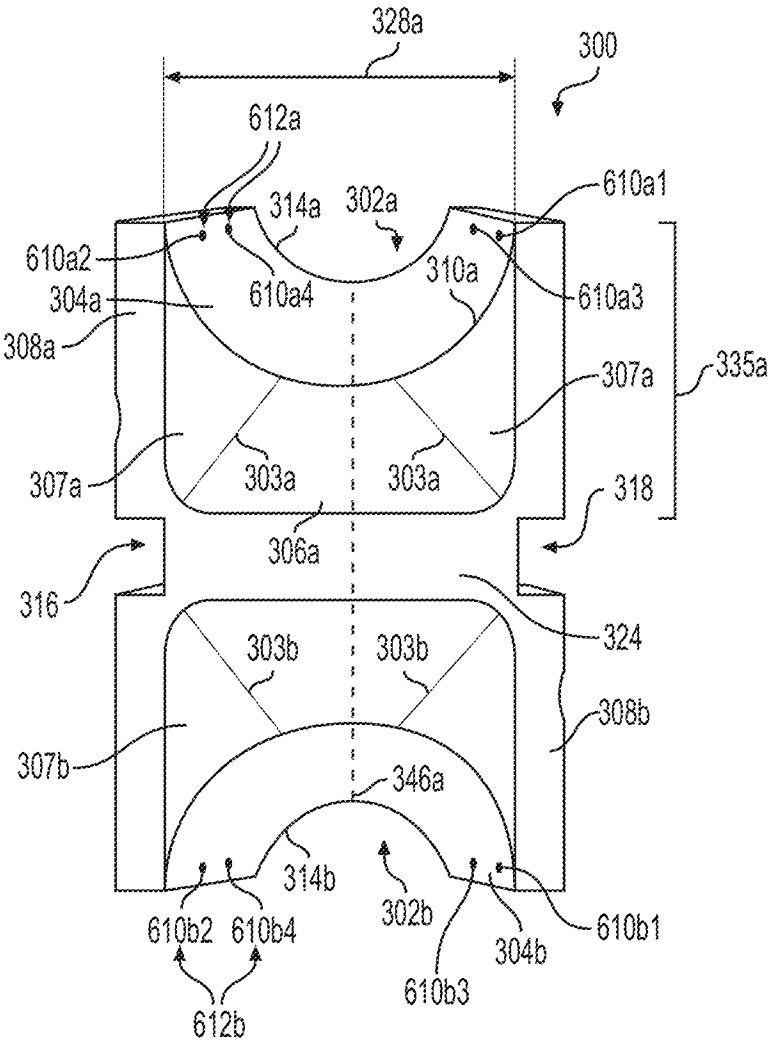
FIG. 9C is an illustration of a front view of the tongue, in accordance with an example embodiment.

In an example embodiment, the first inner surface 304*a* of the first channel 302*a* is substantially arcuate-shaped (also see FIGS. 9B and 9C, which depicts this in more detail). In this example embodiment, the first inner surface 304*a* is arcuate-shaped from a first end 310*a* to a second end 312*a*, and therefore has a arcuate-shaped cross-sectional profile (e.g., arcuate-shaped vertical cross-sectional profile). In an example embodiment, the first channel 302*a* includes a first entrance 330*a* (also see FIG. 9G). In an example embodiment, the first entrance 330*a* is a tapered entrance that exists between a first opening 308*a* of the first channel 302*a*, and the first end 310*a* of the first inner surface 304*a*. In an example embodiment, the first entrance 330*a* is a tapered entrance from the standpoint that the first opening 308*a* is relatively large, and the first opening 308*a* is shaped differently from the arcuate-shape of the first inner surface 304*a*, and the first entrance 330*a* narrows (in width and depth) as the first entrance 330*a* meets the first end 310*a* of the first inner surface 304*a* (see FIG. 9G). In an example embodiment, the first opening 308*a* has a cross-sectional profile that is rectangular-shaped or square-shaped. In an example embodiment, a length of the first entrance 330*a*, from the first opening 308*a* to the first end 310*a* of the first inner surface 304*a*, is about 5-20 mm long, or about 10-14 mm long, or about 12 mm long. In an example embodiment, the length of the first entrance 330*a* is about 2-40% of the longitudinal length 315 of the tongue 300, or about 5-20% of the longitudinal length 315, or about 5-10% of the longitudinal length 315, or about 10% of the longitudinal length 315.

In an example embodiment, the first entrance 330*a* includes a first inclined surface (transition ramp) 306*a*, that inclines from the first opening 308*a* to the first end 310*a* of the first inner surface 304*a*. In this example embodiment, the first end 310*a* of the first inner surface 304*a* is therefore a ridge, where this ridge can be considered an inner inlet of the first channel 302*a*. In an example embodiment, the first entrance 330*a* includes sloped sidewalls 307*a* on an adjacent side of the first inclined surface 306*a* (also see FIGS. 9C and 9G). In an example embodiment, the first entrance 330*a* includes one or more lead lines (seams) 303*a* that cause the first entrance 330*a* to taper, where these one or more lead lines 303*a* can, for instance, delineate where the first inclined surface 306*a* joins with the sloped sidewalls 307*a*. In an example embodiment, it should be understood that this same discussion applies equally to the second channel 302*b* with the second opening 308*b* having the second entrance 330*b*, and the second inner surface 304*b* with the first end 310*b* and the second end 312*b*.

In an example embodiment, and as shown in FIG. 9A, a first sidewall 320 of the major body 301 defines a first groove 350*b*. In an example embodiment, the first groove 350*b* runs substantially along the longitudinal length 315 of the major body 301. In an example embodiment, the first groove 350*b* is adjacent to the second channel 302*b*, as the first groove 350*b* and the second channel 302*b* work together to form the tobacco rod 1*b* and begin to fold the at least one covering 31 around the tobacco rod 1*b*, as described herein.

In an example embodiment, the first groove 350*b* is a convex groove. In an example embodiment, the first groove 350*b* is an irregularly shaped groove. In an example embodiment, the first groove 350*b* includes a first convex surface 340*b* with a first end 342*b* and a second end 344*b*. In an example embodiment, the first end 342*b* is tapered, with a relatively smaller width than the second end 344*b*. In an example embodiment, a width 342*b*1 of the first end 342*b* is about 2.0-3.0 mm, or about 2.4-2.6 mm, or about 2.5 mm, and a width 344*b*4 of the second end 344*b* is about 6.0-8.0 mm, or about 6.9-7.1 mm, or about 7 mm. In an example embodiment, the first end 342*b* is at least partially defined by the first endwall 324. In an example embodiment, the second end 344*b* is at least partially defined by the second endwall 326.

In an example embodiment, and as described in detail in relation to at least FIGS. 9F, 13B, 14A and 14B, the first groove 350*b* is used to allow a lap edge 33 of the at least one covering 31 to glance along the first sidewall 320 of the tongue 300, and allow the lap edge 33 to be pulled over onto the tobacco rod 1*b* as the tobacco rod 1*b* exits the tongue 300 in the compression box 100, without tearing. In an example embodiment, the second sidewall 322 of the major body 301 defines a second groove 350*a* with a second convex surface 340*a* (see at least FIG. 9E) that has the same physical characteristics as the first groove 350*b*. Further details of the first groove 350*b* and the second groove 350*a* are described at least in relation to FIG. 9B.

In an example embodiment, and as shown in FIG. 9A, the first sidewall 320 of the major body 301 defines a third groove 318. In an example embodiment, the third groove 318 runs substantially along the longitudinal length 315 of the major body 301. In an example embodiment, the third groove 318 is located at a mid-section of the major body 301, where the third groove 318 runs through an imaginary horizontal dividing plane 313 that separates the major body 301 into the first portion 305*a* and the second portion 305*b* (see FIG. 9B). In an example embodiment, the third groove 318 is at a same elevation as a fourth groove 316, where the fourth groove 316 is defined by the second sidewall 322 (see FIGS. 9B and 9E). In an example embodiment, the third groove 318 and the fourth groove 316 each have a uniform width (groove height, or elevation), and a uniform depth (depth into the major body 301). In an example embodiment, the third groove 318 and the fourth groove 316 are positioned at substantially a same elevation (height) on the major body 301 of the tongue 300. In an example embodiment, the third groove 318 and the fourth groove 316 converge toward each other, from the first end 309 of the major body 301 to the second end 311 of the major body 301, by virtue of the first sidewall 320 and the second sidewall 322 also converging toward each other (see FIG. 9G), where the converging nature of the third groove 318 and the fourth groove 316 allow the tongue 300 to be fitted into a tongue holder 500 (see at least FIGS. 10A and 11A), as discussed in more detail in relation to FIGS. 10A and 11A, herein.

In an example embodiment, the major body 301 defines a first set of injection ports 612*a* and a second set of injection ports 612*b*. In an example embodiment, the first set of injection ports 612*a* traverses through the first channel 302*a*, and the second set of injection ports 612*b* traverses through the second channel 302*b*. In an example embodiment, the first set of injection ports 612*a* includes one or more injection ports, and the second set of injection ports 612*b* includes one or more injection ports. In an example embodiment, the first set of injection ports 612*a* includes a first injection port 610*a*1, a second injection port 610*a*2, a third injection port 610*a*3, and a fourth injection port 610*a*4. In an example embodiment, the second set of injection ports 612*b* includes a first injection port 610*b*1, a second injection port 610*b*2, a third injection port 610*b*3, and a fourth injection port 610*b*4 (also see FIG. 9C). In an example embodiment, the first set of injection ports 612*a* and the second set of injection ports 612*b* are used to inject at least one substance onto one of the first inner surface 304*a* or the second inner surface 304*b*, respectively, while the rod forming apparatus 10 is in use, in order to comingle the at least one substance with the tobacco rod 1*b* (see FIG. 14B, showing the tobacco rod 1*b* leaving the tongue 300).

In an example embodiment, the at least one substance is water. In an example embodiment, water injection is used to clean and/or lubricate the first inner surface 304*a* and/or the second inner surface 304*b*. In an example embodiment, the water injection is used to increase a moisture content of the tobacco rod 1*b*. In an example embodiment, the water injection is used to mitigate potential tobacco and/or flavorant build-up under conditions where the first channel 302*a* and/or the second channel 302*b* 'run dry,' especially due, at least in part, to overly dry tobacco flowing through the tongue 300 at relatively high rates of speed. In an example embodiment, water injection is performed on a metered basis, using an injection rate that is proper for the blend, consistency and moisture content of tobacco, the machining conditions (rate or production, speed and applied pressure on the tobacco rod 1*b* flowing through the tongue 300, ambient temperature, etc.), the material and surface smoothness of the first inner surface 304*a* and/or the second inner surface 304*b* (e.g., metal material, coated metal material, food-safe plastic/polymer, smooth or rough surface), and the production duration (e.g., the amount of anticipated wear of the first inner surface 304*a* and/or the second inner surface 304*b*), in order to avoid buildup of tobacco and other substances in the tongue 300, as well as buildup of elements of the rod forming apparatus 10 that are downstream of the compression box 100.

In an example embodiment, the injection rate includes an injection of water at regular intervals, between periods of time without any water injection. In another example embodiment, the injection rate includes intermittent water injection at irregular intervals. In an example embodiment, the injection rate of the water is determined via a measurement of an overall dryness of the tobacco, where the measurements are taken before, during or after a duration of time when the rod forming apparatus 10 is in use. In an example embodiment, the injection rate of water is continuous, or continuous for one or more periods of time, followed by periods of time where water is not injected. In an example embodiment, the water injection mitigates jamming, assists in the overall performance of the rod forming apparatus 10, and reduces maintenance demands and down-time of equipment. In an example embodiment, the injection rate of water is used to extend the useful life of the tongue 300, so that the water injection is used to extend the use of the tongue 300 prior to removing the tongue 300 from the rod forming apparatus 10 for maintenance and/or replacement.

In an example embodiment, the at least one substance is at least one flavorant that can become commingled with the tobacco rod 1*b*, as the tobacco rod 1*b* flows through the tongue 300. In an example embodiment, the at least one flavorant may be at least one of a natural flavorant, an artificial flavorant, or a combination of a natural flavorant and an artificial flavorant. For instance, the at least one flavorant may include menthol, etc. In an example embodiment, the at least one substance is a mixture of water and the at least one flavorant. In an example embodiment, the injection of the at least one substance is used to intermittently, or regularly, inject the at least one flavorant and water, at separate intervals, or periods where they are injected at a same time, followed by periods where they are injected separately.

In an example embodiment, the at least one substance is at least one additive. In an example embodiment, the at least one additive changes a property of the tobacco in the tobacco rod 1*b*. In an example embodiment, the additive includes a humectant. In an example embodiment, the humectant is used to adjust and/or maintain a moisture content of the tobacco rod 1*b*, act as a preservative for the tobacco rod 1*b*, or both. In an example embodiment, examples of humectants include glycerol, propylene glycol, or combinations thereof. In an example embodiment, the humectant reduces a water activity in the consumer product 600, thereby reducing an opportunity for growth of micro-organisms. In an example embodiment, the humectant provides a higher moisture feel for a potentially dry composition of the tobacco 1. In an example embodiment, the considerations related to an injection rate, and the impact the humectant has on the tobacco, the compression box 100, and/or the other equipment in the rod forming apparatus 10, are the same as the considerations described in relation to the injection rate of water (discussed herein).

In an example embodiment, the at least one substance is water, the at least one flavorant, the at least one additive, or combinations thereof. In an example embodiment, the injection of the at least one substance is used to inject any or all of these substances, either together, or separately, either at regular or intermittent times, or on a continuous or semi-continuous basis. In an example embodiment, the injection of the at least one substance is used to inject the at least one first flavorant, where water is subsequently injected to flush residual levels of the at least one first flavorant. Following flushing, in an example embodiment, at least one second flavorant is injected. In an example embodiment, the at least one first flavorant is different than the at least one second flavorant.

In an example embodiment, injection of the at least one substance into the tobacco 1 at the compression box 100 is performed in lieu of introducing the at least one substance at a location within the rod forming apparatus 10 that is upstream of the compression box 100. For example, injection of the at least one substance into the tobacco 1 at the compression box 100*a*, is performed instead of introducing the at least one substance into the tobacco 1 at the storage container 5, the feeder 8, the trough 14, or introducing the at least one substance into the tobacco 1 prior to the tobacco 1 being introduced into the rod forming apparatus 10. In another example embodiment, injection of the at least one substance into the tobacco rod 1*b* at the compression box 100 is performed in addition to introducing a same or different substance into the tobacco 1 at a location that is upstream of the compression box 100.

In an example embodiment, the at least one substance is injected into the tobacco rod 1*b* at the compression box 100, so that the elements of the rod forming apparatus 10 that are upstream of the compression box 100 do not need to be subsequently cleaned to remove undesired, residual levels of the at least one substance. For example, in an example embodiment, the at least one substance is injected at the compression box 100, so that residual levels of the at least one substance are not later discovered in the storage container 5, the feeder 8, the trough 14, the upper belt 12, the in-feed belt 20, the lower belt 22, etc. In an example embodiment, injections of water at the compression box 100, following introduction of the at least one substance, cause residual levels of the at least one substance to be flushed from the compression box 100 and/or equipment downstream of the compression box 100. In an example embodiment, introduction of the at least one flavorant at the compression box 100, which may be followed by injections of water at the compression box 100 to flush residual levels of the at least one flavorant (as needed, or if needed), allow for the subsequent introduction of different flavorants into the tobacco 1 without needing to shut down the rod forming apparatus 10 and/or clean major equipment within the rod forming apparatus 10.

In an example embodiment, the at least one substance is injected onto surfaces of the first inner surface 304*a* and/or the second inner surface 304*b*, to ensure that the at least one substance contacts, and in some regards streams along, the first inner surface 304*a* and/or the second inner surface 304*b*. In another example embodiment, the at least one substance is injected within a central location of the cross-sectional flow area of the first channel 302*a* and/or the second channel 302*b*, via the use of an injection tube (not shown), or other structure, that extends away from the first inner surface 304*a* and/or the second inner surface 304*b*, in order to inject the at least one substance within the first channel 302*a* and/or the second channel 302*b* at a location that is somewhere other than directly on the surface of the first inner surface 304*a* and/or the second inner surface 304*b*.

In an example embodiment, the at least one substance is injected into the first set of injection ports 612*a* and/or the second set of injection ports 612*b*, via a pump, a test syringe pump, a micro-pump, a squeeze bulb (manually actuated) pump, a syringe, a fluid metering device, any well-known pump device, or combinations thereof. In an example embodiment, the at least one substance is injected individually into each of the first set of injection ports 612*a* and/or the second set of injection ports 612*b*, either at the same time or at different times. In an example embodiment, the at least one substance is injected into a manifold (tubular connecting structure), where the manifold is connected to at least one, or all, of the first set of injection ports 612*a* and/or the second set of injection ports 612*b*. In at least some example embodiments, use of the manifold allows for injection into some or all of the first set of injection ports 612*a* and/or the second set of injection ports 612*b* simultaneously. In an example embodiment, the manifold includes isolation valves to isolate or cease a flow of the at least one substance to some or all of the first set of injection ports 612*a* and/or the second set of injection ports 612*b*.

In an example embodiment, the first channel 302*a*, the second channel 302*b*, portions of the tongue 300 that contact the tobacco 1 and/or the at least one covering 31, and/or the entire tongue 300, are made from a food-safe plastic or polymer material. In an example embodiment, the first channel 302*a*, the second channel 302*b*, portions of the tongue 300 that contact the tobacco 1 and/or the at least one covering 31, and/or the entire tongue 300, are made from a polyether ether ketone (PEEK).

In another example embodiment, the first channel 302*a*, the second channel 302*b*, portions of the tongue 300 that contact the tobacco 1 and/or the at least one covering 31, and/or the entire tongue 300, are made from a metal, such as stainless steel or carbon steel. In this example embodiment, the first channel 302*a*, the second channel 302*b*, portions of the tongue 300 that contact the tobacco 1 and/or the at least one covering 31, and/or the entire tongue 300, are made from metal that may be coated with a food-safe coating. In an example embodiment, the food-safe coating is made from a food-safe plastic or polymer material, or a polyether ether ketone (PEEK).

FIG. 9B is an illustration of another perspective view of the tongue 300, in accordance with an example embodiment. In an example embodiment, and as shown in FIG. 9B, the imaginary horizontal dividing plane 313 is an imaginary plane (it is not physically visible, on the tongue 300), that divides the major body 301 into the first portion 305*a* and the second portion 305*b*. In an example embodiment, and as described above, the first portion 305*a* and the second portion 305*b* are identical, from the standpoint that they both share identical elements, including the first channel 302*a* and the second channel 302*b* being identical. In an example embodiment, and as shown in FIG. 9B, the first groove 350*b* and the second groove 350*a* are on opposite sides of the major body 301. In another example embodiment, the first groove 350*b* and the second groove 350*a* are on a same side of the major body 301, such that they are each defined by the first sidewall 320, or they are both defined by the second sidewall 322 (see FIG. 9E).

In an example embodiment, the second endwall 326 of the major body 301 define the first outlet 312*a* of the first channel 302*a*, and the second outlet 312*b* of the second channel 302*b*.

In an example embodiment, and as shown in FIG. 9B, the second end 344*b* of the first convex surface 340*b* of the first groove 350*b* is an irregularly shaped convex edge that includes a sharply angled portion 344*b*1, a first peak 344*b*2 and a substantially horizontal portion 344*b*3. In an example embodiment, the shape of the first convex surface 340*b* of the first groove 350*b*, including the shape of the second end 344 of the first convex surface 340*b*, allow the at least one covering 31 to glide along the first sidewall 320 of the tongue 300, as the at least one covering 31 passes through the compression box 100. In an example embodiment, the sharply angled portion 344*b*1 has an angle that is steep enough that the first peak 344*b*2 of the second end 344 extends beyond (traverses across) a vertical centerline 346 of the second endwall 326 (see FIG. 9D), where the vertical centerline 346 runs through a center of a longitudinal length of the second endwall 326. In an example embodiment, the second groove 350*a* includes a second peak 344*a*2 and a sharply angled portion 344*a* that is identical to the first peak 344*b*2 and the sharply angled portion 344*b*1 of the first groove 350*b* (FIG. 9D). In an example embodiment, and as shown in FIG. 9B, the substantially horizontal portion 344*b*3 is substantially parallel (horizontal) with the upper surface 317*a* and the lower surface 317*b* of the major body 301. In an example embodiment, and as shown in FIG. 9B, the substantially horizontal portion 344*b*3 of the first groove 350*b* is substantially perpendicular to the first sidewall 320 of the major body 301.

FIG. 9C is an illustration of a front view of the tongue 300, in accordance with an example embodiment. In an example embodiment, and as described above, the first channel 302*a* includes a first inclined surface 306*a* with sloped sidewalls 307*a* that act as a transition between the first opening 308*a* and the first end 310*a* of the first inner surface 304*a*. In an example embodiment, the first end 310*a* of the first inner surface 304*a* acts as a ridge (elevation high point), relative to the first inclined surface 306*a*.

In an example embodiment, the first end 310*a* of the first inner surface 304*a* has a first radius of curvature that is larger than a second radius of curvature of the second end 312*a* of the first inner surface 304*a*.

In an example embodiment, an interior width 328*a* and an interior depth 335*a* of the first opening 308*a* is relatively small. In this example embodiment, the interior width 328*a* of the first opening 308*a* of the tongue 300 is about 7-12 mm, or about 9 mm, and the interior depth 335*a* of the first opening 308*a* is about 7-12 mm, or about 8.5 mm. Meanwhile, in an example embodiment, the width 78 of the discharge end 321 of the in-feed section 4 (see FIGS. 1, 3 and 7) is in a range of about 5-10 mm, or about 8 mm, and the depth 74 of the discharge end 321 is about 5-10 mm, or about 8 mm. In an example embodiment, a size of the first opening 308*a* of the tongue 300 is relatively close to, but slightly larger than, a size of the discharge end 321 of the in-feed section 4, to avoid irregular feeding and/or undesired re-expansion of the tobacco 1 that enters the tongue 300. In an example embodiment, the interior width 328*a* of the first opening 308*a* of the tongue 300 is about 5.0-15% larger than the width 78 of the discharge end 321 of the in-feed section 4, or 6.25-12.5% larger than the width 78, or about 6.25% larger than the width 78, and the interior depth 335*a* of the first opening 308*a* is about 5.0-15% larger than the depth 74 of the discharge end 321 of the in-feed section 4, or about 6.25-12.5% larger than the depth 74, or about 6.25% larger than the depth 74. In an example embodiment, the interior width 328*a* of the first opening 308*a* is about 0.25-1.5 mm larger than the width 78 of the discharge end 321 of the in-feed section 4, or about 0.5 mm larger than the width 78, or about 1.0 mm larger than the width 78, and the interior depth 335*a* of the first opening 308*a* is about 0.0-0.25 mm larger than the depth 74 of the discharge end 321 of the in-feed section 4, or about 0.5 mm larger than the depth 74. In an example embodiment, a radius of curvature 331*a* of the first outlet 312*a* is about 3.43-3.53 mm, or about 3.48 mm (plus or minus 0.5 mm). In an example embodiment, a radius 333 of the tobacco rod 1*b* exiting the tongue 300 (see FIG. 14B) is about 3.4 mm.

In an example embodiment, the physical characteristics of the first channel 302*a* apply equally to the second channel 302*b*.

FIG. 9D is an illustration of a rear view of the tongue 300, in accordance with an example embodiment. In an example embodiment, and as shown in FIG. 9D, the first sidewall 320 and the second sidewall 322 converge towards each other, from the first endwall 324 (FIG. 9C) to the second endwall 326. In an example embodiment, and as described above, the first peak 344*b*2 of the first groove 350*b* and the second peak 344*a*2 of the second groove 350*a* traverse across the vertical centerline 346 of the second endwall 326. The vertical centerline 346 is an imaginary line that runs along a center of the longitudinal length of the second endwall 326. In an example embodiment, the vertical centerline 346 runs along a vertical dividing plane 346*a* (see FIG. 9C), where the vertical dividing plane 346*a* is an imaginary plane that vertically divides the major body 301 into sides that are physically identical.

Figure 9E:
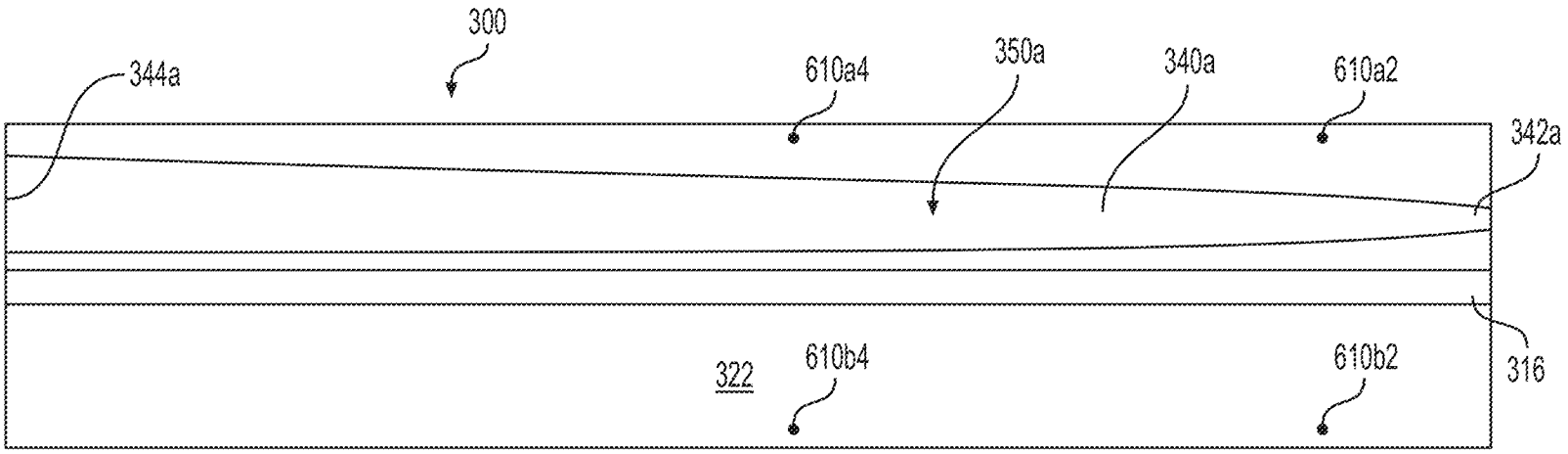
FIG. 9E is an illustration of a first side view of the tongue, in accordance with an example embodiment.

FIG. 9E is an illustration of a first side view of the tongue 300, in accordance with an example embodiment. In an example embodiment, and as shown in FIG. 9E, the second sidewall 322 of the tongue 300 is an identical mirror-image of the first sidewall 320 (see FIG. 9F) of the tongue.

Figure 9F:
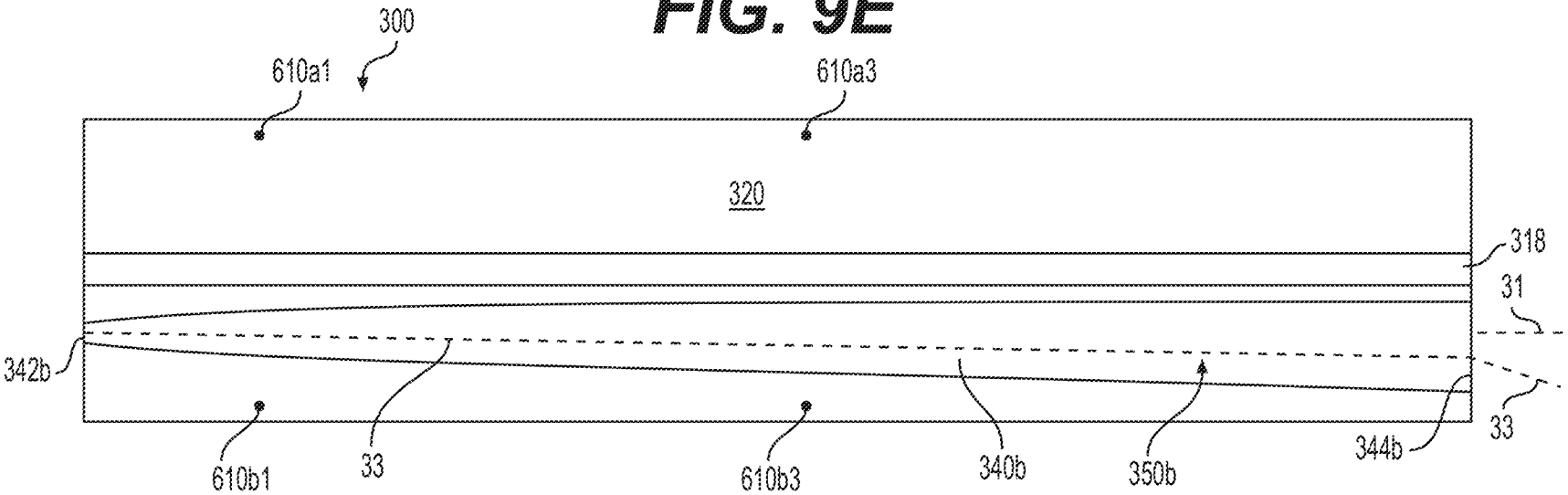
FIG. 9F is an illustration of a second side view of the tongue, in accordance with an example embodiment.

FIG. 9F is an illustration of a second side view of the tongue 300, in accordance with an example embodiment. In an example embodiment, once the tongue 300 is installed on the rod forming apparatus 10, and the rod forming apparatus 10 is in use, the lap edge 33 of the at least one covering 31 travels across the first sidewall 320, as substantially shown in FIG. 9F. In this example embodiment, as the lap edge 33 reaches the second end 344*b* of the first groove 350*b*, the lap edge 33 is pulled downward, over a top of the tobacco rod 1*b* (also see FIG. 14B). In an example embodiment, the lap edge 33 is pulled downward due to the short folder 42 holding down the lap edge 33 (see FIG. 13B). In an example embodiment, once the lap edge 33 is pulled downward, the adhesive applicator 40 is able to reach across a top of the lap edge 33, and apply the adhesive 35 to the free edge 37 (see at least FIGS. 13B and 14B). In this example embodiment, once the at least one covering passes through the compression box 100, the free edge 37 of the at least one covering is standing up, in a substantially vertical position (see at least FIGS. 13B and 14B). In an example embodiment, the adhesive applicator 40 can apply the adhesive either between the compression box 100 and the short folder 42, or between the short folder 42 and the finishing folder 44.

Figure 9G:
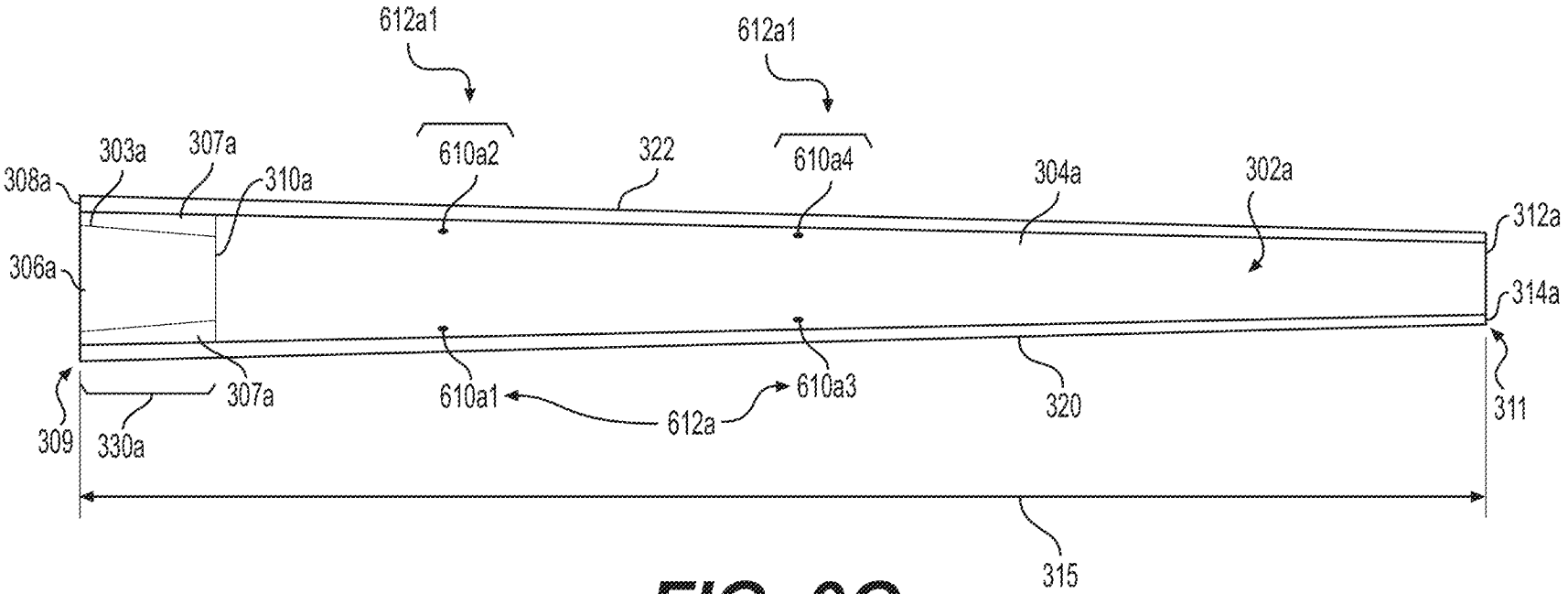
FIG. 9G is an illustration of an overhead view of the tongue, in accordance with an example embodiment.

FIG. 9G is an illustration of an overhead view of the tongue 300, in accordance with an example embodiment. In an example embodiment, and as shown in FIG. 9G, the first sidewall 320 and the second sidewall 322 converge, such that the tongue 300 has a tapered profile (as depicted in FIG. 9G). That is to say, a width of the tongue 300, from the first end 309 to the second end 311, is narrowed. In an example embodiment, a width of the tongue 300 continuously and linearly narrows, from the first end 309 to the second end 311.

In an example embodiment, a width of the first channel 302*a* (and, likewise, a width of the second channel 302*b*), substantially spans across a width of the tongue 300, as shown for instance in FIG. 9G. In an example embodiment, because the width of the tongue 300 narrows, and a width of the first inner surface 304*a* also narrows, this causes the tobacco rod 1*b* (see FIGS. 14A and 14B) to continue to narrow and become compressed, as the tobacco rod 1*b* is formed and compressed while it flows through the tongue 300 in the compression box 100 (see at least FIGS. 1 and 12B). In an example embodiment, the radius of curvature of the first inner surface 304*a*, between the first end 310*a* and the second end 312*a*, is reduced. In an example embodiment, the radius of curvature of the first inner surface 304*a*, between the first end 310*a* and the second end 312*a*, is linearly and continuous reduced.

In an example embodiment, and as discussed in relation to the example embodiment of FIG. 9A, the tongue 300 may define a single injection port, or any number of the first set of injection ports 612*a* and the second set of injection ports 612*b* (also see FIG. 9A). In an example embodiment, and as discussed in relation to the example embodiment of FIG. 9A, the tongue 300 defines the first set of injection ports 612*a* at different locations along the longitudinal length 315 of the tongue 300 (where this feature also applies to the second channel 302*b*). For example in an example embodiment, a first group 612*a*1 of the first set of injection ports 612*a* is located near the first opening 308*a* of the first channel 302*a*, and a second group 612*a*2 of the first set of injection ports 612*a* is positioned near a mid-section of the first channel 302*a*. In an example embodiment, the mid-section of the first channel 302*a* is a middle of the first channel 302*a*, relative to the longitudinal length 315 of the tongue 300. In an example embodiment, the second group 612*a*2 of the first set of injection ports 612*a* is located between the mid-section of the first channel 302*a*, and the first outlet 312*a* of the first channel 302*a*.

In an example embodiment, the first group 612*a*1 of the first set of injection ports 612*a* includes at least two injection ports (e.g., the first injection port 610*a*1, and the second injection port 610*a*2). In this example embodiment, the first injection port 610*a*1 and the second injection port 610*a*2 traverse sidewalls of the first inner surface 304*a*, as shown in at least FIG. 9A. Similarly, in an example embodiment, the second group 612*a*2 of the first set of injection ports 612*a* traverse sidewalls of the first inner surface 304*a*, as shown in at least FIG. 9A. Other shapes for the first inner surface 304*a* of the first channel 302*a* are contemplated, where the first set of injection ports 612*a* are at one or more locations that traverse the first inner surface 304*a*. In an example embodiment, disclosed features of the first set of injection ports 612*a* apply equally to the second set of injection ports 612*b*.

In an example embodiment, more than two groups of injection ports (e.g. more than 612*a*1 and 612*a*2) are defined by the tongue 300.

In an example embodiment, the first set of injection ports 612*a* includes only a single injection port. In an example embodiment, the first set of injection ports 612*a* includes only two injection ports. In this example embodiment, the two injection ports are either at a same location, along the longitudinal length 315 of the tongue 300, or the two injection ports are at different locations, along the longitudinal length 315 of the tongue 300. In an example embodiment, the first set of injection ports 612*a* are located between the first opening 308*a* and the mid-section of the first channel 302*a*, along the longitudinal length 315 of the tongue 300.

In an example embodiment, the first set of injection ports 612*a* are defined at any location along the longitudinal length 315 of the tongue 300, and may include any number of injection ports.

Figure 10B:
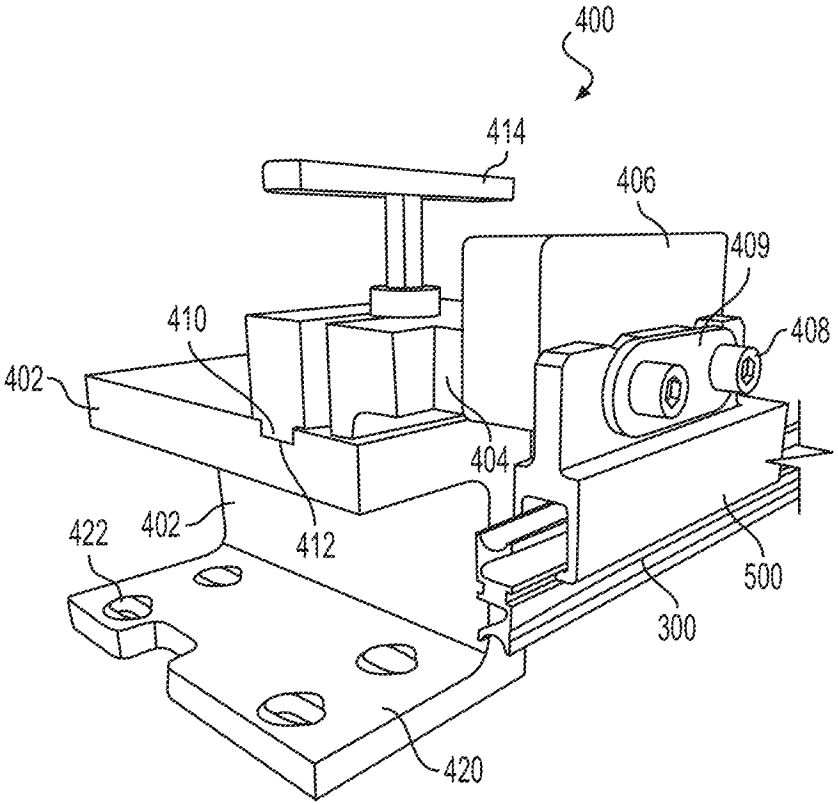
FIG. 10B is an illustration of another perspective view of the tongue support assembly holding the tongue, in accordance with an example embodiment.
Figure 10A:
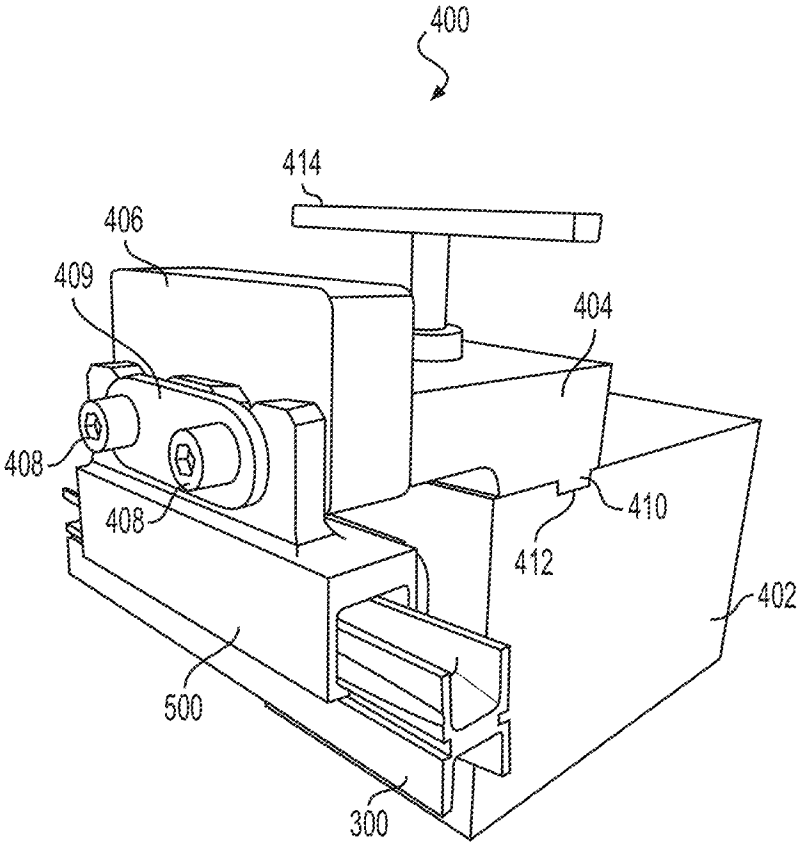
FIG. 10A is an illustration of a perspective view of a tongue support assembly holding the tongue, in accordance with an example embodiment.

FIG. 10A is an illustration of a perspective view of a tongue support assembly 400 holding the tongue, in accordance with an example embodiment. In an example embodiment, the tongue support assembly 400 holds a tongue holder 500, where the tongue 300 slides into the tongue holder 500 and is held in a fixed position that selectively aligns either the first channel 302*a* or the second channel 302*b* with a groove 152 of the lower plate 150 of the compression box 100 (see at least FIG. 12A).

Figure 11A:
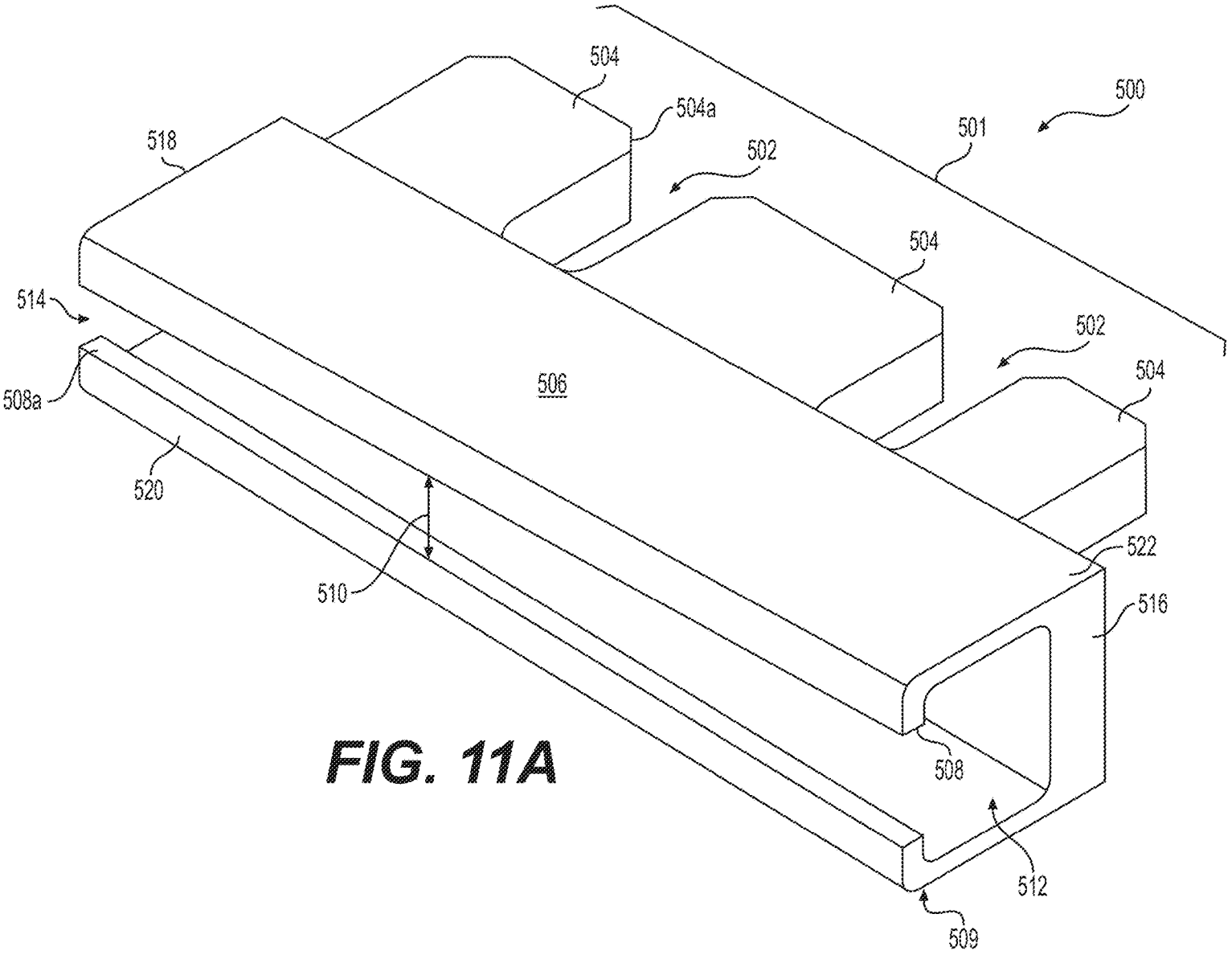
FIG. 11A is an illustration of a perspective view of a tongue holder, in accordance with an example embodiment.

In an example embodiment, the tongue support assembly 400 includes major elements that include: a base 402, an arm 404, a mounting block 406, and engaging structure 408 (FIG. 10B). In an example embodiment, the engaging structure 408 includes bolts. In an example embodiment, the engaging structure 408 mates with an engaging structure 501 of the tongue holder 500 (FIG. 11A). In an example embodiment, the engaging structure 408 interfaces with, and fits between, one or more slots 502 defined by stubs 504 extending from the tongue holder 500 (FIG. 11A). In another example embodiment, the engaging structure 408 includes fasteners, clasps, hooks that are capable of gripping and/or holding a portion of the tongue holder 500, to stabilize the tongue 300 into a locked position over the lower plate 150 of the compression box 100. In an example embodiment, the engaging structure 408 includes a mounting plate 409 to assist in mounting the tongue holder 500 on the mounting block 406.

In an example embodiment, the arm 404 is connected to mounting block 406 and the base 402. In an example embodiment, the arm 404 is slideably positioned on the base 402. In an example embodiment, a ridge 401 extends from the arm 404 and mates with a groove 412 in the base 402. In an example embodiment, the ridge 410 slides in the groove 412 to allow positioning of the arm 404 and the mounting block 406 relative to the base 402 in a first direction (Y-axis). In an example embodiment, the tongue support assembly 400 does not include the mounting block 406 and instead just includes the arm 404. In an example embodiment, the tongue support assembly 400 does not include the base 402, as the arm 404 connects to the rod forming apparatus 10 by itself, and without the use of the base 402.

Figure 10C:
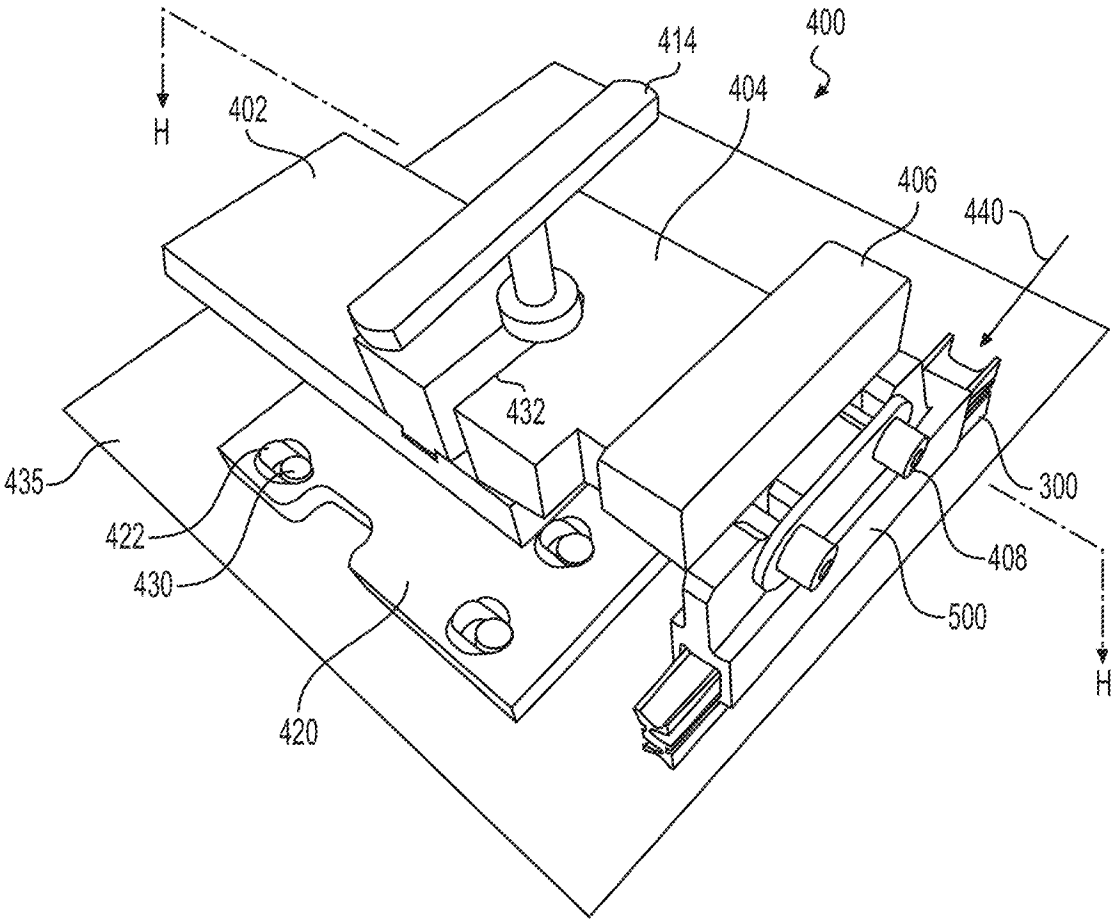
FIG. 10C is an illustration of an overhead perspective view of the tongue support assembly holding the tongue, in accordance with an example embodiment.
Figure 10D:
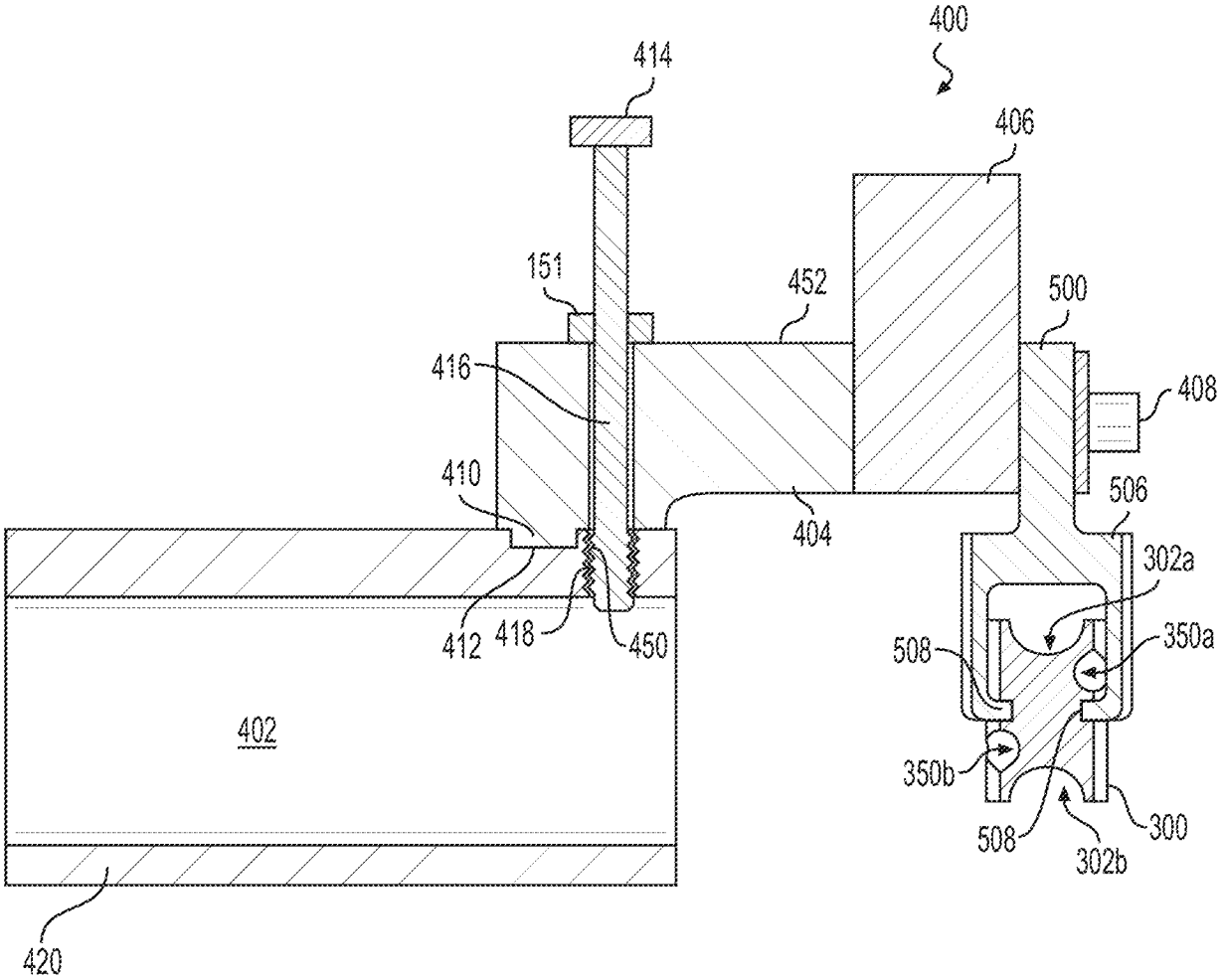
FIG. 10D is an illustration of a cross-sectional view of the tongue support assembly holding the tongue, in accordance with an example embodiment.

In an example embodiment, a handle 414 is used to tighten the arm 404 onto the base 402, where the handle is in communication with a threaded shaft 416 that screws into a threaded hole 418 in the base 402 (see FIG. 10D). In an example embodiment, other similar structure is contemplated for attaching the arm 404 to the base 402, and/or fine tuning the position of the arm 404 on the base 402.

In an example embodiment, the base 402 includes a platform (mounting plate) 420 that extends from the base 402. In an example embodiment, the platform 420 includes one or more elongated holes 422 that allow for the platform 420, and in turn the base 402, to be bolted onto the rod forming apparatus 10 at a location that is near the compression box 100. In an example embodiment, the platform 420 bolts onto a surface 435 of the rod forming apparatus 10, where the bolts 430 can slide within the one or more elongated holes 422 (FIG. 10C), allowing for fine positioning of the tongue support assembly 400, and in turn the tongue 300, in a second direction (X-axis).

In an example embodiment, further fine positioning of the tongue 300 is accomplished via the engaging structure 408 of the mounting block 406 interfacing with and sliding between the one or more slots 502 of the tongue holder 500, in order to control the position of the tongue in a third direction (Z-axis).

FIG. 10B is an illustration of another perspective view of the tongue support assembly 400 holding the tongue 300, in accordance with an example embodiment. In an example embodiment, and as shown in FIG. 10B, the platform 420 extends from a side of the tongue support assembly 400. In an example embodiment, the platform 420 may extend from and side of the tongue support assembly 400.

FIG. 10C is an illustration of an overhead perspective view of the tongue support assembly 400 holding the tongue holder 500 and the tongue 300, in accordance with an example embodiment. In an example embodiment, the arm 404 defines a slot 432 that allows the arm 404 to slide on the base 402, while the handle 414 remains connected to the base 402 in a substantially a stationary position relative to the arm 404.

In an example embodiment, the tongue 300 slides into the tongue holder 500 in a first direction 440, where the varying width (thickness) of the tongue 300 causes the tongue 300 to become lodged within the tongue holder 500 to resist further movement of the tongue 300 in the first direction 440 (as described in greater detail in relation to FIGS. 11A-11D). In an example embodiment, the first direction 440 corresponds with a direction that the tobacco rod 1*b* travels through the tongue 300.

FIG. 10D is an illustration of a cross-sectional view (view H-H of FIG. 10C) of the tongue support assembly 400 holding the tongue holder 500 and the tongue 300, in accordance with an example embodiment. In an example embodiment, the handle 414 is in communication with the shaft 416 that includes threads 450 that mate with the threaded hole 418, in order cause the shaft 416 to be tightened down onto the arm 404 as a collar 151 of the shaft 416 contacts an upper surface 452 of the arm 404.

In an example embodiment, and as described above, the tongue 300 is inserted into the tongue holder 500 in the first direction 440 (see FIG. 10C). In an example embodiment, the tongue 300 slides into a shaft (hollow body) 506 of the tongue holder 500 to hold the tongue 300 in the one of two positions, where either the first channel 302*a* or the second channel 302*b* extends from the tongue holder (see at least FIG. 10A). In an example embodiment, the tongue holder 500 includes an engaging structure 501 (FIG. 11A) that holds the tongue 300 in the tongue holder 500. In an example embodiment, the engaging structure includes ribs 508 that oppose each other. In an example embodiment, the ribs 508 of the shaft 506 fit into the third groove 318 and the fourth groove 316 and allow the tongue 300 to slide within the tongue holder 500 until a converging width 510 between the ribs 508 (see FIG. 11A) causes movement of the tongue 300 to be resisted in the first direction 440, as the tongue 300 reaches a fully inserted position (as shown in at least FIG. 10A).

FIG. 11A is an illustration of a perspective view of the tongue holder 500, in accordance with an example embodiment. In an example embodiment, and as described above, the tongue holder 500 includes the engaging structure 501. In an example embodiment, the engaging structure 501 allows the tongue holder to be connected to the mounting block 406 of the tongue support assembly 400. In an example embodiment, the engaging structure 501 allows the tongue holder 500 to be selectively connected to the mounting block 406 at varying elevations to fine tune the position of the tongue 300 on the compression box 100 (see FIG. 12A). In an example embodiment, the engaging structure 501 includes the stubs 504 which define the slots 502, where the engaging structure 408 of the mounting block 406 fits within the slots 502 to allow the tongue holder 500 and the tongue 300 to be selectively connected to the mounting block 406 at varying elevations. In an example embodiment, the stubs 504 include beveled corners 504*a* that allow the tongue holder 500 to be more easily mounted.

In an example embodiment, the tongue holder 500 selectively holds the tongue 300 (see at least FIG. 10A) in one of two positions. In this example embodiment, the first position extends the first channel 302*a* of the tongue 300 downward and away from the tongue holder 500 so that the first channel 302*a* can be aligned with the groove 152 of the lower plate 150 (see at least FIG. 12A), and the second position extends the second channel 302*b* of the tongue 300 downward and away from the tongue holder 500 so that the second channel 302*b* can be aligned with the groove 152 of the lower plate 150. In an example embodiment, the shaft 506 of the tongue holder 500 defines a cavity 512 that accepts the tongue 300. In an example embodiment, a lower surface 520 of the shaft 506 defines a slot 514, where the ribs 508 of the lower surface 520 oppose and face each other within the slot 514. In an example embodiment, the slot 514 has a converging (varying) width 510 that lessens from a first end 516 to a second end 518 of the shaft 506, such that distal ends 508*a* of the ribs 508 form the narrowest portion of the slot 514. In an example embodiment, the ribs 508 mate with the third groove 318 and the fourth groove 316 of the tongue 300. In an example embodiment, the first sidewall 320 and the second sidewall 322 of the tongue 300 converge, along the longitudinal length 315 of the tongue (see at least FIG. 9G), such that the tapered profile of the tongue 300 is conformed to a size and shape of the ribs 508, where the ribs 508 also converge. In this example embodiment, the convergence of the ribs 508, the first sidewall 320 and the second sidewall 322, allow the tongue 300 to become wedged within the shaft 506 of the tongue holder 500, as the tongue 300 is inserted into the tongue holder 500 in the first direction 440 (see the first direction 440 in FIG. 10C).

Figure 11B:
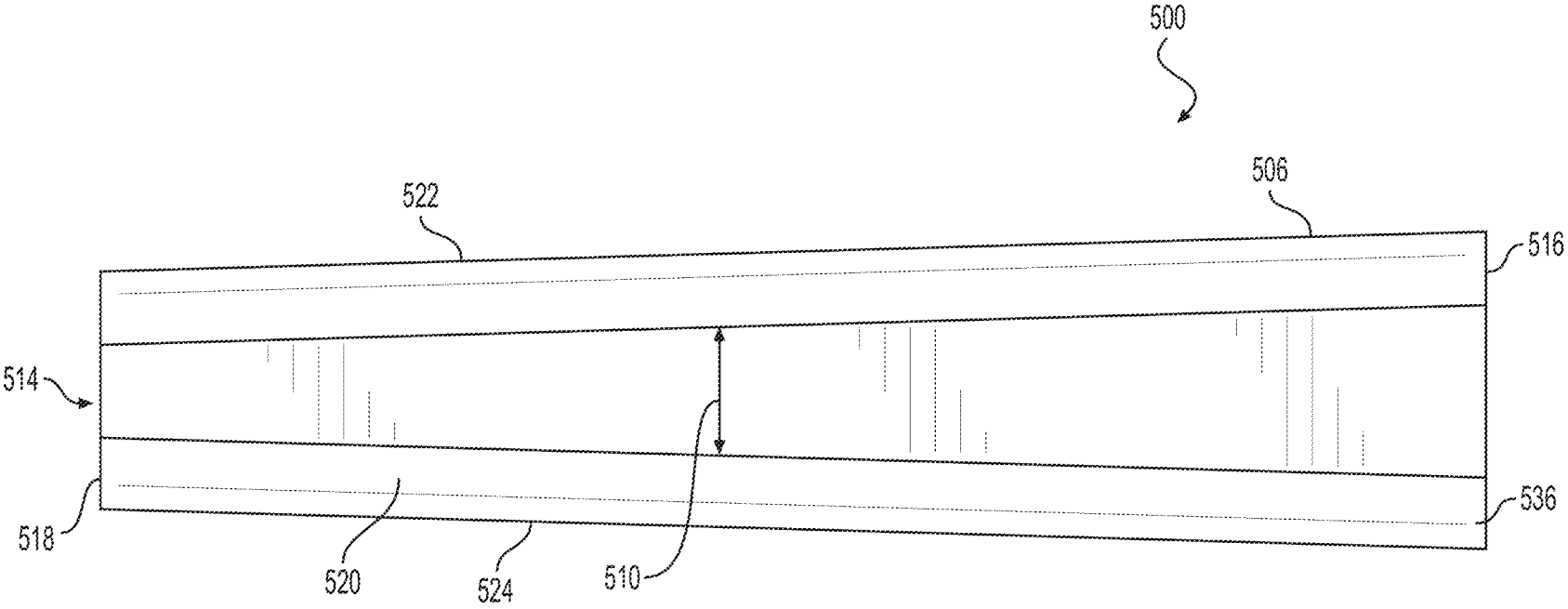
FIG. 11B is an illustration of a lower view of the tongue holder, in accordance with an example embodiment.

FIG. 11B is an illustration of a lower view of the tongue holder 500, in accordance with an example embodiment. In an example embodiment, a first sidewall 522 and a second sidewall 524 of the shaft 506 of the tongue holder 500 converge towards each other, from the first end 516 to the second end 518 of the shaft 506. In this example embodiment, the tongue holder 500 therefore has a tapered profile that accepts the tapered profile of the tongue 300 (see at least FIG. 9G).

Figure 11C:
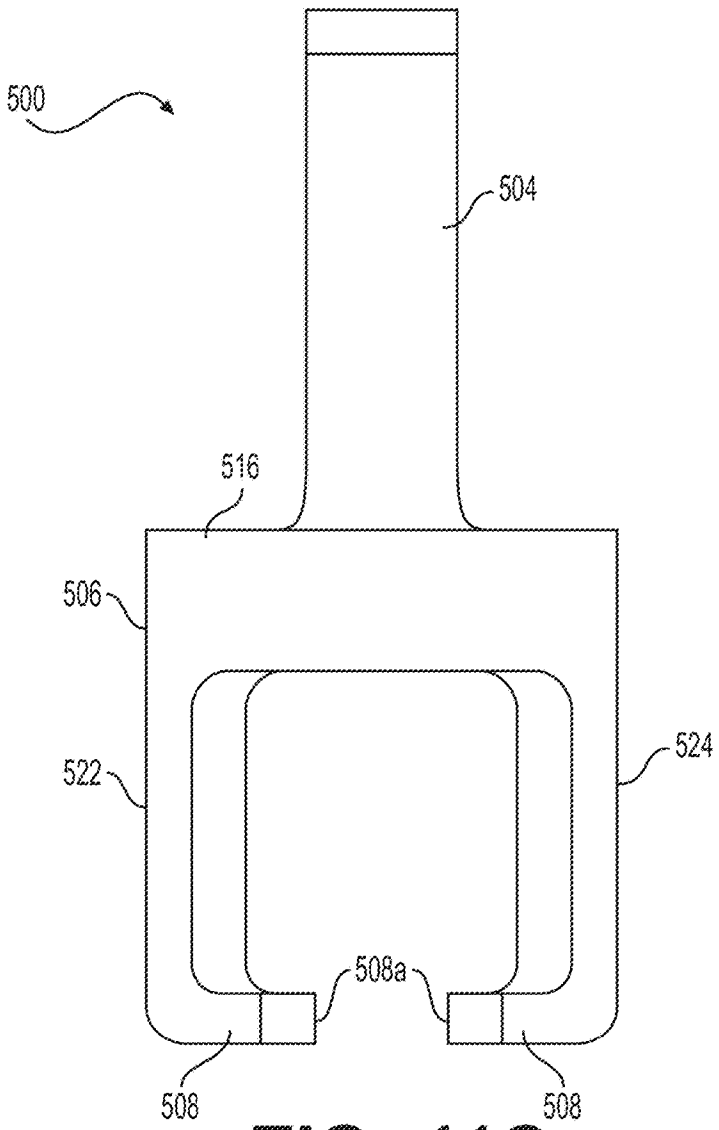
FIG. 11C is an illustration of a front view of the tongue holder, in accordance with an example embodiment.

FIG. 11C is an illustration of a front view of the tongue holder 500, in accordance with an example embodiment. In an example embodiment, and as depicted in FIG. 11C, the first sidewall 522 and the second sidewall 524 of the shaft 506 converge, from the first end 516 to the second end 518 (FIG. 11B) of the shaft 506, where the converging width 510 of the ribs 508 help resist the tongue 300 from sliding into the shaft 506 in the first direction 440 (FIG. 10C) once the tongue 300 is lodged in the shaft 506 in a fully inserted position (see at least FIG. 10A).

FIG. 12A is an illustration of a perspective view of the compression box 100, in accordance with an example embodiment. In an example embodiment, the mounting block 406 of the tongue support assembly 400 (FIG. 10A) holds the position of the tongue 300 above the lower plate 150 so that either the first channel 302*a* or the second channel 302*b* are aligned with the groove 152 of the lower plate 150. In an example embodiment, the first channel 302*a* or the second channel 302*b* align with a surface 154 of the groove 152 to form a flow channel 166. In an example embodiment, the surface 154 of the groove 152 is arcuate-shaped, so that the flow channel 166 forms a tobacco rod 1*b* that is cylindrically-shaped (see FIG. 14B, which is a vertical cross-sectional view of the tobacco rod 1*b* as it exits the tongue 300). Other shapes of the surface 154 of the groove 152, and the flow channel 166, are contemplated.

In an example embodiment, the tongue 300 can be removed from the shaft 506 of the tongue holder 500, and a position of the tongue 300 can be switched (turned upside down), so that the first channel 302*a* is faced downward and aligned on the groove 152. In an example embodiment, the ability to utilize either the first channel 302*a* or the second channel 302*b* of the tongue 300, can assist in reducing maintenance and cleaning downtime costs and effort, increasing the availability of the rod forming apparatus 10 to run for longer periods, and easing an operation of the rod forming apparatus 10 by reducing a number of times that an operator needs to retrieve a new tongue 300 to install in the rod forming apparatus 10.

In an example embodiment, a free side 150*e* of the lower plate 150 (a side of the lower plate 150 that does not include the tongue support assembly 400), includes an inclined portion 150*f*. In an example embodiment, the inclined portion 150*f* provides a gradually increasing depth to the free side 150*e* of the lower plate 150. In an example embodiment, the inclined portion 150*f* may include an upper surface that includes a flat portion 150*c*, between a front edge 150*g* of the lower plate 150 and a valley 150*d*2 of the lower plate 150. In an example embodiment, the inclined portion 150*f* further includes an inclined (portion) surface 150*b*, between the valley 150*d*2 and a ridge 150*d*1, where the ridge 150*d*1 is a higher elevation than the valley 150*d*2. In an example embodiment, a remaining upper surface of the free side 150*e* of the lower plate 150 may have a common, elevated height, which has a higher elevation than the flat portion 150*c* and the inclined surface 150*b*. The inclined portion 150*f*, with the flat portion 150*c* and the inclined surface 150*b*, can be seen in better detail in FIG. 13A, where the inclined surface 150*b* has an elevation (height) 150*b*2 that increases, from a lower elevation 150*b*3 of the flat portion 150*c*, to a higher elevation 150*b*1 (starting at the ridge 150*d*1) for the remainder of the lower plate 150. In an example embodiment, a purpose of a gradual elevation of the free side 150*e* of the lower plate 150, from the front edge (leading edge) 150*g* of the lower plate 150 to a back edge 150*h* of the lower plate 150 (see FIG. 12A), is to cause the free edge 37 of the at least one covering 31 to transition from a 'flared out' configuration (as shown in FIG. 14A) to a vertical configuration (as shown in FIG. 14B). This allows the free edge 37 of the at least one covering 31 to be in a proper orientation as the free edge 37 passes by the adhesive application 40.

Figure 12C:
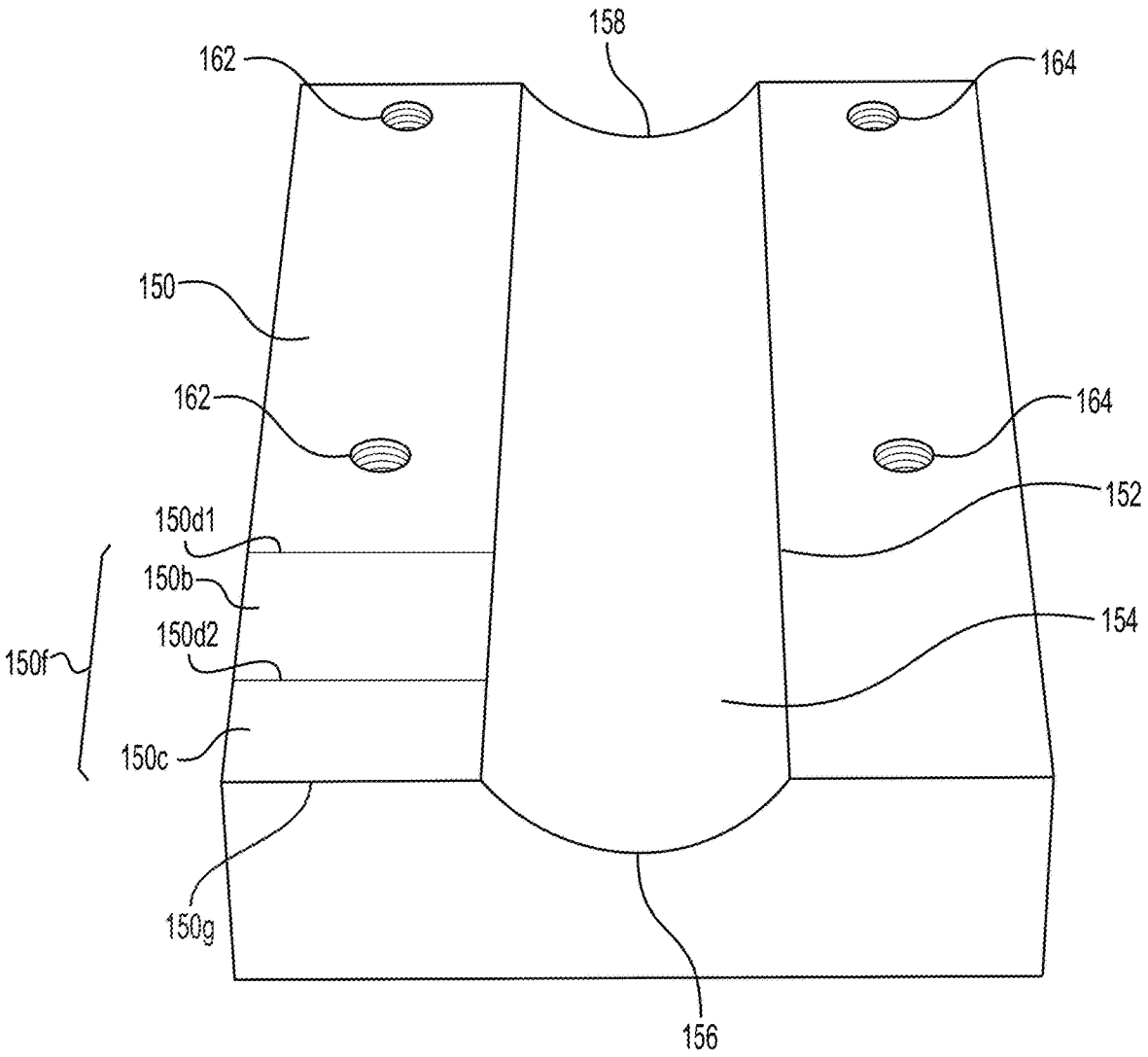
FIG. 12C is an illustration of a lower plate of the compression box, in accordance with an example embodiment.

As shown in FIG. 12A, in an example embodiment, an upper surface of the second side 150*i* of the lower plate 150 (the side of the lower plate 150 that the tongue support assembly 400 is on), is a uniformly flat surface (as shown in FIGS. 12A-12C). In another example embodiment, the upper surface of the second side 150*i* of the lower plate 150 may also include an inclined portion (not shown) that is identical to the inclined portion 150*f* of the free side 150*e* of the lower plate 150, as the inclined portion may assist in gently folding the lap edge 33 of the at least one covering 31 so that the lap edge 33 is in a vertical position, prior to the short folder 42 further folding the lap edge 33 so that the lap edge 33 is folded face down on top of the tobacco rod 1*b* as the at least one covering 31 exits the tongue 300 (see FIGS. 13B and 14B).

In an example embodiment, the lower plate 150 includes one or more mounting bolt holes 162 that can be used to mount the lower plate 150 on the rod forming apparatus 10.

FIG. 12B is an illustration of a perspective view of the compression box 100, with the lower belt 22, the tobacco column 1*a* and the at least one covering 31 shown passing through the compression box 100, in accordance with an example embodiment. In an example embodiment, the lower belt 22 runs through the compression box 100, between the tongue 300 and the lower plate 150, in order to transport the at least one covering 31 and the tobacco column 1*a* into and through the compression box 100. In an example embodiment, the at least one covering 31 enters the compression box 100 in a 'flared out' configuration (also see FIG. 14A).

In an example embodiment, and as shown in at least FIGS. 1 and 3, the tobacco column 1*a* flows through the squeeze bars 60/62, and is compressed down to a tobacco rod 1*b* (FIG. 14A), whereupon the tobacco rod 1*b* and the at least one covering 31 enter and flow through the compression box 100. Specifically, in an example embodiment, the tobacco rod 1*b* flows through the second channel 302*b* and a groove 152 of the lower plate 150 (also see FIG. 12C), as the lap edge 33 and the free edge 37 of the at least one covering 31 travel along the sides of the tongue 300. In an example embodiment, and as described in relation to FIG. 9G, the width of the second channel 302*b* is continually reduced, from the first endwall 324 to the second endwall of the tongue 300. In an example embodiment, and as discussed in relation to FIGS. 9F and 13B, the lap edge 33 of the at least one covering 31 glances along the first convex surface 340*b* of the first groove 350*b* on the first sidewall of the tongue 300 (see FIG. 9F), prior to the lap edge 33 being folded over onto the top of the tobacco rod 1*b*, as the tobacco rod 1*b* exits the tongue 300 (see at least FIGS. 13B and 14B). In an example embodiment, and as further in relation to FIG. 13B, the free edge 37 of the at least one covering 31 exits the tongue 300 in substantially a vertical orientation (also shown in FIG. 12B), in order to allow the adhesive applicator 40 to apply the adhesive to the free edge (also see FIG. 14B).

In an example embodiment, because a radius of curvature of an inlet 156 of the groove 152 of the lower plate 150 is larger than an outlet 158 of the groove 152 (see FIG. 12C), a resulting channel 166 created by the second channel 302*b* and the groove 152 has a decreasing vertical cross-sectional flow area, from a front to a back of the compression box 100, which results in compressing and compacting the tobacco rod 1*b* (see FIG. 14B) to a desired shape and size with a desired packing density. In an example embodiment, the desired packing density of the tobacco rod 1*b* can depend on a consistency and moisture content of the tobacco 1. In an example embodiment, the channel 166 has a circular vertical cross-sectional flow area. In an example embodiment, other shapes of the vertical cross-sectional flow area of the channel 166 are contemplated.

In an example embodiment, and as described above, as the at least one covering 31 enters and begins to pass through the compression box 100, a lower side of the free edge 37 of the at least one covering 31 begins to contact the inclined portion 150*f* of the lower plate 150. In an example embodiment, a thickness of the inclined portion 150*f* increases, from the front edge 150*g* to the ridge 150*d*1 of the lower plate 150, which causes the free edge 37 of the at least one covering 31 to fold slightly until the free edge 37 is in a vertical, or nearly-vertical position. In an example embodiment, as the at least one covering 31 exits the compression box 100, the free edge 37 of the at least one covering is in a substantially vertical position (see FIG. 14B), which allows the adhesive applicator 40 to apply the adhesive 35 to the free edge 37, either before or after the short folder 42 (see at least FIGS. 1 and 13B).

In an example embodiment, the lap edge 33 of the at least one covering 31 is folded by the compression box 100, where the lap edge 33 enters the compression box 100 in the initial 'flared out' configuration (see FIG. 14A), and is folded face down on top of the tobacco rod 1*b* (see FIG. 14B) as the at least one covering exits the compression box 100. In an example embodiment, the folding of the lap edge 33 is somewhat assisted by the lap edge 33 being gently pressed between an edge of the groove 152 (FIGS. 12A and 12C) and the first sidewall 320 of the tongue 300. In an example embodiment, and as discussed above, the upper surface of the second side 150*i* of the lower plate 150 can include an inclined portion (not shown) which may be identical to the inclined portion 150*f* on the free side 150*e* of the lower plate 150. In an example embodiment, the upper surface of the second side 150*i* of the lower plate 150 is substantially flat. In an example embodiment, the lap edge 33 is at least partially assisted in being folded in the compression box 100, due to the short folder 42 pinning the lap edge 33 face down (see FIG. 13B), where the lap edge 33 is almost immediately folded down onto the tobacco rod 1*b* once the lap edge passes along the second end 344*b* of the first convex surface 340*b* of the tongue 300 (see at least FIGS. 9F and 13B).

FIG. 12C is an illustration of the lower plate 150 of the compression box 100, in accordance with an example embodiment. In an example embodiment, and as shown in FIG. 12C, the groove 152 runs along an upper surface of the lower plate 150. In an example embodiment, the groove 152 is arcuate-shaped. In an example embodiment, the groove 152 has a radius of curvature, along a longitudinal length of the groove 152, that matches the radius of curvature of the second inner surface 304*b* of the second channel 302*b*. In an example embodiment, the radius of curvature of the outlet 158 of the groove 152 matches a radius of curvature 331*b* of the second channel 302*b* (see FIG. 9D).

In an example embodiment, the one or more mounting bolt holes 164 are used to connect the lower plate 150 to the rod forming apparatus 10.

Figure 13A:
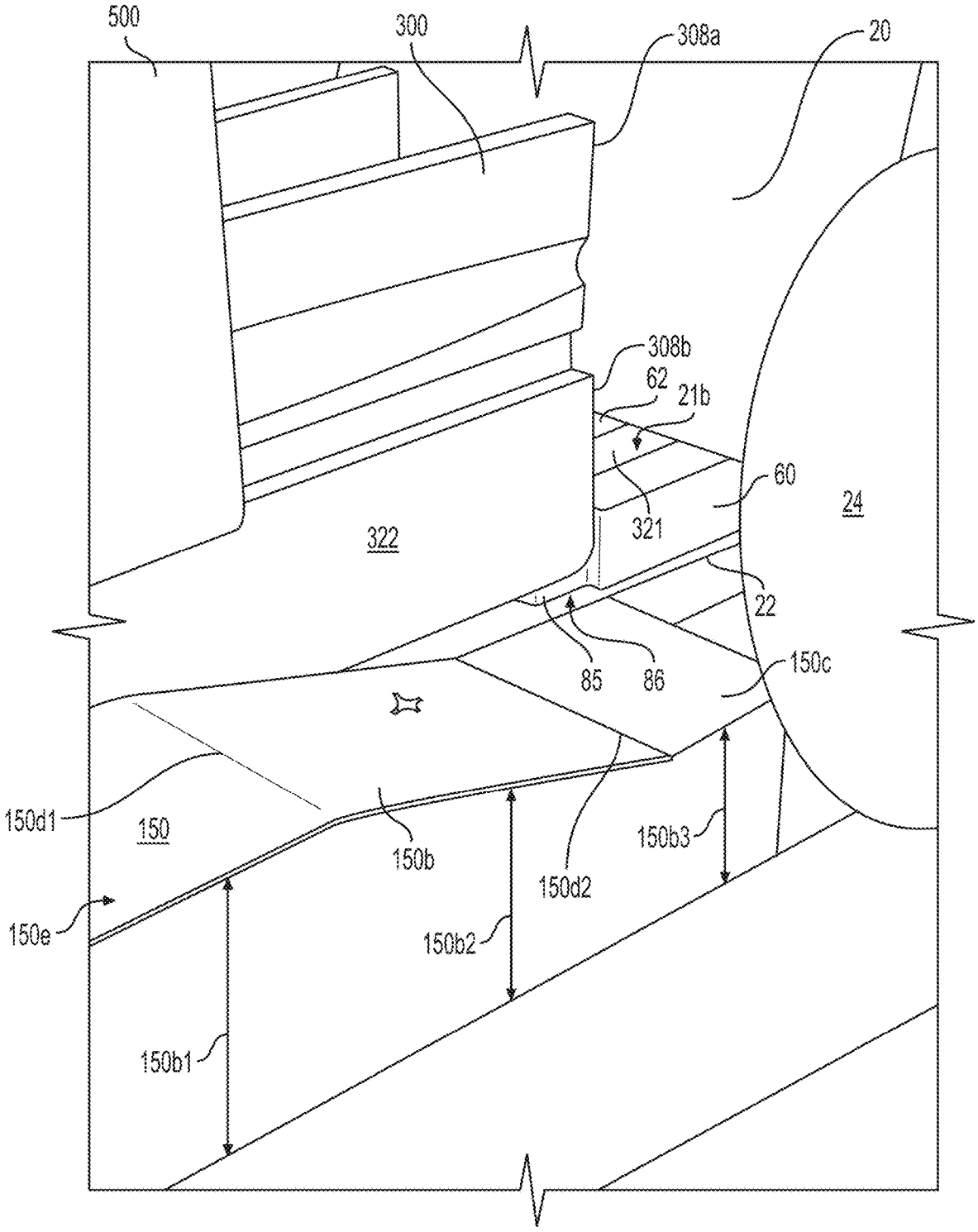
FIG. 13A is an illustration of the tongue support assembly holding the tongue in the compression box, where the tongue is interfacing with the squeeze bars, in accordance with an example embodiment.

FIG. 13A is an illustration of the tongue 300 being held and supported in the compression box 100, where the tongue 300 is interfacing with the squeeze bars 60/62, in accordance with an example embodiment. In an example embodiment, the tongue support assembly 400 (not visible in FIG. 13A) holds the tongue holder 500, which in turn holds the tongue 300 in alignment with the groove 152 of the lower plate 150 (as shown in at least FIG. 12A).

In an example embodiment, the first squeeze bar 60 includes at least one protrusion 85 that fits inside the inner wall (along the sloped sidewalls 307*b*, as in FIG. 9C) of the second opening 308*b* of the tongue 300. In another example embodiment, the at least one protrusion 85 includes a protrusion on either side of the second opening 308*b* (e.g., a protrusion that fits along the sloped sidewall 307*b*, as shown in FIG. 9C, and a protrusion that contacts the second sidewall 322 of the tongue 300). In an example embodiment, the first squeeze bar 60 does not include at least one protrusion 85, and instead the tip 86 of the first squeeze bar 60 abuts the second opening 308*b* of the tongue 300.

In an example embodiment, the horizontal section 21*b* of the channel 21, which is defined in part by the first squeeze bar 60 and the second squeeze bar 62, discharges the tobacco column 1*a* (see at least FIG. 5) into the second opening 308*b* of the tongue 300. In an example embodiment, the lower belt 22 assists in transporting the tobacco column 1*a* into the second opening 308*b* (also see FIG. 12B). It should be understood that FIG. 13A is shown without the tobacco column 1*a* and the at least one covering 31 traveling through the compression box 100, so as to not obstruct the view of the first squeeze bar 60 and the second squeeze bar 62 interfacing with the second opening 308*b* of the tongue 300.

Figure 13B:
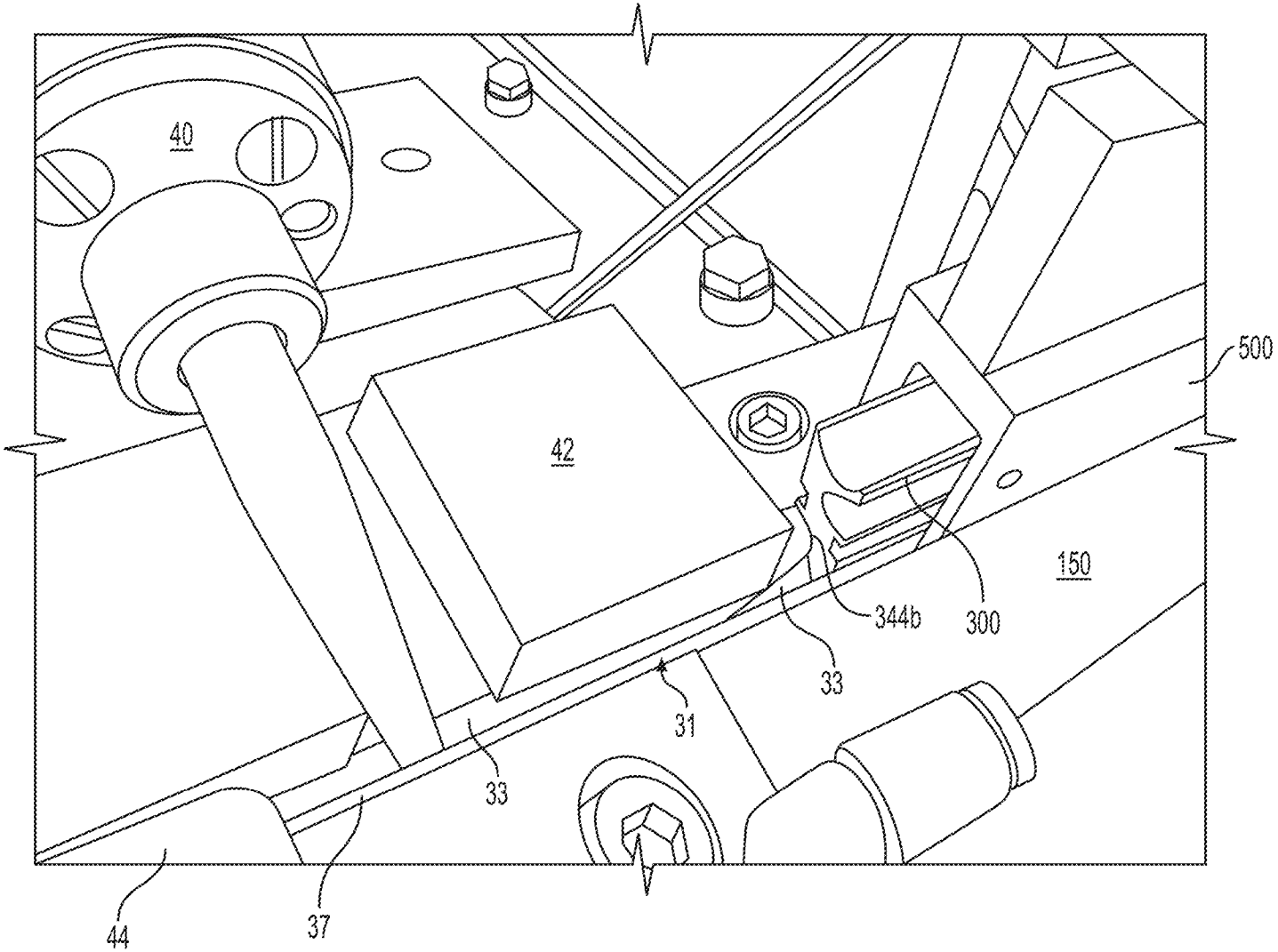
FIG. 13B is an illustration of the tongue support assembly holding the tongue in the compression box, where the tongue is shown interfacing with a short folder, in accordance with an example embodiment.

FIG. 13B is an illustration of the tongue 300 being held and supported in the compression box 100, where the tongue 300 is shown interfacing with a short folder 42, in accordance with an example embodiment. In an example embodiment, the at least one covering 31 exits the tongue 300 in substantially the configuration shown in FIG. 14B, where the free edge 37 of the at least one covering 31 is standing up in a substantially vertical position, and the lap edge 33 of the at least one covering 31 is folded over, or in the process of being folded over, onto the top of the tobacco rod 1*b*. The tobacco rod 1*b* is obstructed from view in FIG. 13B, as the lap edge 33 is covering the top of the tobacco rod 1*b*. In an example embodiment, the lap edge 33 of the at least one covering 31 travels through the compression box 100 by running along the first convex surface 340*b* of the first groove 350*b* (see FIG. 9F), and the lap edge 33 travels along the second end 344*b* of the first convex surface 340*b* (shown in at least FIGS. 9F and 13B), prior to the lap edge 33 being immediately folded face-down on the tobacco rod 1*b* by the short folder 42. In an example embodiment, by folding the lap edge 33 down onto the tobacco rod 1*b*, the adhesive applicator 40 is able to reach over the lap edge 33, and apply the adhesive 35 to the free edge 37 of the at least one covering 31 (as shown in at least FIGS. 13B and 14B).

FIG. 14A is an illustration of the cross-sectional view (view A-A of FIG. 1) of the tobacco rod 1*b* being bound, in accordance with an example embodiment. In an example embodiment, and as shown in FIG. 14A, the tobacco rod 1*b* is formed by the tobacco column 1*a* flowing between the tips 86 of the horizontal portion 84 of the squeeze bars 60/62 (FIGS. 5 and 8A), and flowing into the channel 166 (FIG. 12B) of the compression box 100 that is formed by the groove 152 of the lower plate 150 and the second channel 302*b* of the tongue 300. Specifically, in an example embodiment, the tobacco column 1*a* is transformed, from a column with a square-shaped or a rectangular-shaped cross-section (matching a cross-section of the second entrance 330*b* of the tongue 300), into a circular-shaped cross-section, as the tobacco column 1*a* is pressed through the second entrance 330*b* of the tongue 300, and the tobacco column 1*a* flows past the first end 310*b* of the second inner (arcuate-shaped) surface 304*b* of the second channel 302*b*.

In an example embodiment, the lap (folded) edge 33 and free edge 37 of the at least one covering 31 remain extended, in the 'flared out' configuration relative to the tobacco rod 1*b* (as shown in FIG. 14A), where a mid-section 31*a* of the at least one covering 31 is contacting, and is partially wrapped around, a surface of the tobacco rod 1*b*, as the tobacco rod 1*b* flows into the second channel 302*b* (FIG. 12B). To be clear, view A-A of FIG. 14A is a vertical cross-sectional view of the tobacco rod 1*b*, as the tobacco rod 1*b* passes across the first end 310*b* of the second inner surface 304*b* of the second channel 302*b* of the tongue 300 (see at least FIGS. 1 and 9A).

FIG. 14B is another illustration of the cross-sectional view (view B-B of FIG. 1) of the tobacco rod 1*b* being bound, in accordance with an example embodiment. In an example embodiment, and as shown in FIG. 14B, the tobacco rod 1*b* and the at least one covering 31 has already passed by the adhesive applicator 40, and the adhesive 35 has been applied to an upper (inner) surface of the free edge 37 of the at least one covering 31 (see at least FIGS. 1 and 13B). In an example embodiment, and as shown in FIG. 14B, the lap edge 33 is being folded toward the tobacco rod 1*b* as the tobacco rod 1*b* enters the short folder 42, where the short folder 42 is at least partially assisting in pinning the lap edge 33 down so that the lap edge 33 is laying over the tobacco rod 1*b*. In an example embodiment, the radius 333 of the tobacco rod 1*b* is about 3.4 mm, where this radius substantially corresponds with the tobacco rod 1*b* of the consumer product 600 (FIG. 15).

FIG. 14C is another illustration of the cross-sectional view the tobacco rod 1*b* (view C-C of FIG. 1) being bound, in accordance with an example embodiment. In an example embodiment, and in this configuration, the tobacco rod 1*b* has passed through the short folder 42 and is entering the finishing folder 44. In this configuration, the lap edge 33 has already been folded over onto the tobacco rod 1*b*, and the free edge 37 of the at least one covering 31 is extended upward and is beginning to be folded (in direction 39) over the top portion of the tobacco rod 1*b*.

FIG. 14D is another illustration of the cross-sectional view the tobacco rod 1*b* (view D-D of FIG. 1) being bound, in accordance with an example embodiment. In an example embodiment, and in this configuration, the tobacco rod 1*b* has passed through the finishing folder 44, where the free edge 37 of the at least one covering 31 has been folded over onto the lap edge 33, and the lap edge 33 and free edge 37 are pinned together on the tobacco rod 1*b* by the adhesive 35.

In an example embodiment, following the finishing folder 44, the tobacco rod 1*b* enters the heater 46 so that the heater 46 may apply heat to the at least one covering 31, in order to cure the adhesive 35 and fuse the at least one covering 31 around the tobacco rod 1*b* to form a finished rod 41. In an example embodiment, the finished rod 41 leaves the heater 46 and enters the cutter 48, to cut sections of the finished rod 41 in order to form the consumer product 600.

FIG. 15 is an illustration of the consumer product 600 that is made from the rod forming apparatus 10, in accordance with an example embodiment. In an example embodiment, the consumer product 600 is a rolled tobacco product. In an example embodiment, the consumer product 600 is a cigar. In another example embodiment, the consumer product 600 is a cigarette.

In an example embodiment, the tobacco 1 is shredded tobacco that is suitable for machine-made cigars. In an example embodiment, the tobacco 1 has a moisture content of about 10-20%, or about 12-18%. In an example embodiment, the tobacco 1 is blended pipe tobacco, or blended packing tobacco, that is suitable for packing a pipe. In an example embodiment, the tobacco 1 is a blend of various types of shredded, moist, tacky tobacco. In an example embodiment, the tobacco 1 is, for example, flue-cured tobacco, Burley tobacco, Maryland tobacco, Oriental tobacco, rare tobacco, specialty tobacco, reconstituted tobacco, or combinations thereof. In an example embodiment, the tobacco 1 is pasteurized. In another example embodiment, the tobacco 1 is fermented.

In an example embodiment, the tobacco 1 includes the at least one substance, as described above, where the at least one substance includes the at least one flavorant, the at least one additive, water (moisture), or combinations thereof. In an example embodiment, the at least one flavorant includes any natural or synthetic flavorant or aroma, such as menthol, etc. In an example embodiment, the at least one flavorant includes flavor compounds that include acids, alcohols, esters, aldehydes, ketones, pyrazines, or combinations thereof. In an example embodiment, the flavor compounds include, for example, phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, ethylacetate, isoamylacetate, propylisobutyrate, isobutylbutyrate, ethylbutyrate, ethylvalerate, benzylformate, limonene, cymene, pinene, linalool, geraniol, or combinations thereof.

In at least one example embodiment, the tobacco 1 used in the manufacture of machine-made cigars, which is made by the rod forming apparatus 10, is a pipe tobacco blend having a degree of tackiness imparted thereto.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A tongue for rod forming, comprising:

a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other.

2. The tongue of claim 1, wherein the major body further includes:

a first portion, the first portion defining the first channel, and a second portion, the second portion being connected to the first portion, the second portion defining the second channel, wherein the first portion and the second portion are identical to each other.

3. The tongue of claim 1, wherein the first channel includes a first inner surface, the second channel includes a second inner surface, and the first inner surface and the second inner surface both have a substantially arcuate-shaped cross-sectional profile.

4. The tongue of claim 3, wherein the first inner surface has a first radius of curvature, the second inner surface has a second radius of curvature, and the first radius of curvature and the second radius of curvature each continually reduce in size from the first end to the second end of the major body.

5. The tongue of claim 1, wherein the first channel has a first width, the second channel has a second width, and the first width and the second width each continually reduce in size from the first end of the major body to the second end of the major body.

6. The tongue of claim 1, wherein the major body includes:

a first sidewall and a second sidewall that oppose each other, the first sidewall and the second sidewall converging towards each other from the first end to the second end of the major body to cause the major body to have a tapered profile.

7. The tongue of claim 6, wherein the first channel has a first width, the second channel has a second width, and the first width and the second width each substantially span from the first sidewall to the second sidewall to cause each of the first channel and the second channel to have a tapered profile.

8. The tongue of claim 3, wherein the first channel includes a first opening, the second channel includes a second opening, and the first opening and the second opening each have a cross-sectional profile that is one of rectangular-shaped or square-shaped.

9. The tongue of claim 8, wherein the first channel includes a first tapered entrance between the first opening and a first end of the first inner surface, and the second channel includes a second tapered entrance between the second opening and a first end of the second inner surface.

10. The tongue of claim 9, wherein the first tapered entrance includes a first inclined surface between the first opening and a first end of the first inner surface, and the second tapered entrance includes a second inclined surface between the second opening and a first end of the second inner surface.

11. The tongue of claim 10, wherein the first tapered entrance includes a first pair of sloped sidewalls on adjacent sides of the first inclined surface, and the second tapered entrance includes a second pair of sloped sidewalls on adjacent sides of the second inclined surface.

12. The tongue of claim 1, wherein the major body includes:

a first sidewall defining a first groove running substantially along the first longitudinal length, the first groove being adjacent to the first channel, and a second sidewall defining a second groove running substantially along the first longitudinal length, the second groove being adjacent to the second channel.

13. The tongue of claim 12, wherein the first groove includes a first tapered end and a first enlarged end, and the second groove includes a second tapered end and a second enlarged end, the first tapered end and the second tapered end being at least partially defined by the first end of the major body, and the first enlarged end and the second enlarged end are at least partially defined by the second end of the major body.

14. The tongue of claim 13, wherein the first enlarged end of the first groove includes a first irregularly shaped convex edge that includes a first sharply angled portion and a first substantially horizontal portion, and the second enlarged end of the second groove includes a second irregularly shaped convex edge that includes a second sharply angled portion and a second substantially horizontal portion.

15. The tongue of claim 14, wherein the first substantially horizontal portion and the second substantially horizontal portion are respectively angled to be about perpendicular to the first sidewall and the second sidewall of the major body.

16. The tongue of claim 14, wherein the major body includes a first endwall and a second endwall on the first end and the second end of the major body, respectively, and the first sharply angled portion and the second sharply angled portion each traverse across a first centerline, the first centerline running through a center of a second longitudinal length of the second endwall of the major body.

17. The tongue of claim 13, wherein the first sidewall defines a third groove, and the second sidewall defines a fourth groove, the third groove and the fourth groove being substantially at a same elevation of the major body.

18. The tongue of claim 17, wherein, the third groove and the fourth groove exist along a first plane, the first plane dividing the tongue into a first portion and a second portion, the first portion defining the first channel and the second portion defining the second channel, the first portion and the second portion being identical to each other.

19. The tongue of claim 1, wherein the major body defines at least one first injection port and at least one second injection port, the at least one first injection port traversing through a first inner surface of the first channel and the at least one second injection port traversing through a second inner surface of the second channel.

20. The tongue of claim 1, wherein the first channel includes a first opening, and the second channel includes a second opening, and the first opening and the second opening each have an interior width that is about 7-12 mm wide and an interior depth that is about 7-12 mm.

21. The tongue of claim 9, wherein a first length of the first tapered entrance and a second length of the second tapered entrance are each about 5-20% of the first longitudinal length of the major body.

22. The tongue of claim 9, wherein a first length of the first tapered entrance and a second length of the second tapered entrance are each about 5-10% of the first longitudinal length of the major body.

23. The tongue of claim 1, wherein the first longitudinal length of the major body is about 115-160 mm.

24. The tongue of claim 13, wherein the first tapered end and the second tapered end each are about 2.0-3.0 mm wide, and the first enlarged end and the second enlarged end each are about 6.0-8.0 mm wide.

25. A tongue support assembly with a tongue, comprising:

a tongue; and a tongue holder configured to selectively hold the tongue in one of a first position and a second position, the tongue including a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other, and wherein the first position causes the first channel of the tongue to extend from the tongue holder and the second position causes the second channel to extend from the tongue holder.

26. The tongue support assembly of claim 25, wherein the tongue holder includes:

a hollow body, the hollow body including engaging structure that mates with opposing grooves defined by a first sidewall and a second sidewall of the tongue to selectively hold the tongue in one of the first position and the second position.

27. The tongue support assembly of claim 26, wherein the engaging structure includes ribs that oppose each other, the ribs converging towards each other from a first end to a second end of the hollow body, and a first sidewall and a second sidewall of the tongue both converge towards each other along the first longitudinal length of the major body so that the tongue can be wedged between the ribs as the tongue is inserted into the hollow body in a direction that is toward the second end of the hollow body.

28. The tongue support assembly of claim 25, further comprising:

a base, the base being configured to connect the tongue support assembly to a rod forming apparatus; and an arm configured to hold the tongue holder, the arm being slideably positioned on the base to assist the tongue support assembly in positioning the tongue on a lower plate of the rod forming apparatus to form a compression box, the tongue holder being configured to align the first channel with a groove defined by the lower plate if the tongue is in the first position, and the tongue holder being configured to align the second channel with the groove if the tongue is in the second position.

29. A rod forming apparatus for forming consumer product into a rod, the rod forming apparatus comprising:

an in-feed section configured to convey a column of tobacco in a downward direction, the in-feed section having a discharge end; and a finishing section configured to receive the column of tobacco from the discharge end, the finishing section being configured to compress and roll the column of tobacco into a tobacco rod that is wrapped, the finishing section including a compression box, the compression box including, a tongue, the tongue including, a major body, the major body having a first longitudinal length that runs from a first end to a second end of the major body, the major body including, a first channel defined along a first edge of the major body, a second channel defined along a second edge of the major body, the first channel and the second channel being hollow and running substantially along the first longitudinal length from the first end to the second end of the major body, the first channel and the second channel opposing each other and facing away from each other, and a lower plate defining a first groove, the tongue configured to be oriented in one of a first position and a second position, the first position causing the first channel to be aligned with the first groove to interface with the discharge end, and the second position causing the second channel to be aligned with the first groove to interface with the discharge end.

30. The rod forming apparatus of claim 29, wherein the major body of the tongue further includes:

a first portion, the first portion defining the first channel, and a second portion, the second portion connected to the first portion, the second portion defining the second channel, wherein the first portion and the second portion are identical to each other.

31. The rod forming apparatus of claim 29, wherein the first channel includes a first inner surface, the second channel includes a second inner surface, and the first inner surface and the second inner surface both have a substantially arcuate-shaped cross-sectional profile that has a continually reducing radius of curvature from the first end to the second end of the major body.

32. The rod forming apparatus of claim 29, wherein the major body of the tongue includes, a first sidewall and a second sidewall that oppose each other, the first sidewall and the second sidewall converging towards each other from the first end to the second end of the major body to cause the major body to have a tapered profile.

33. The rod forming apparatus of claim 31, wherein the first channel includes a first opening, the second channel includes a second opening, and the first opening and the second opening each have a cross-sectional profile that is one of rectangular-shaped or square-shaped.

34. The rod forming apparatus of claim 33, wherein the first channel includes a first tapered entrance between the first opening and a first end of the first inner surface, and the second channel includes a second tapered entrance between the second opening and a first end of the second inner surface.

35. The rod forming apparatus of claim 29, wherein the major body of the tongue includes:

a first sidewall defining a second groove running substantially along the first longitudinal length, the second groove being adjacent to the first channel, and a second sidewall defining a third groove running substantially along the first longitudinal length, the third groove being adjacent to the second channel.

36. The rod forming apparatus of claim 35, wherein the first groove includes a first tapered end and a first enlarged end, and the second groove includes a second tapered end and a second enlarged end, the first tapered end and the second tapered end being on the first end of the major body and the first enlarged end and the second enlarged end being on the second end of the major body.

37. The rod forming apparatus of claim 32, wherein the first sidewall defines a fourth groove, and the second sidewall defines a fifth groove, the fourth groove and the fifth groove being substantially at a same elevation of the major body.

38. The rod forming apparatus of claim 29, further comprising:

a tongue support assembly, including, a tongue holder configured to hold the tongue, a base, and an arm configured to hold the tongue holder, the arm being slideably positioned on the base to assist the tongue support assembly in positioning the tongue on the lower plate, the tongue holder being configured to selectively orient the tongue in the first position or the second position.

39. The rod forming apparatus of claim 38, wherein the tongue holder including a hollow body with ribs that oppose each other, the ribs converging towards each other from a first end to a second end of the hollow body, and a first sidewall and a second sidewall of the tongue both converge towards each other along the first longitudinal length of the major body so that the tongue can be wedged between the ribs as the tongue is inserted into the hollow body in a direction that is toward the second end of the hollow body.

40. The rod forming apparatus of claim 29, wherein the first channel includes a first opening, the second channel includes a second opening, and the first opening and the second opening each have an interior width that is about 5-15% larger than a width of discharge end.

41. The rod forming apparatus of claim 29, wherein the first channel includes a first opening, the second channel includes a second opening, and the first opening and the second opening each have an interior width that is about 0.25-1.5 mm larger than a width of the discharge end.

42. The rod forming apparatus of claim 29, wherein the first channel includes a first opening, the second channel includes a second opening, and the first opening and the second opening each have an interior width that is about 7-12 mm wide and an interior depth that is about 7-12 mm.

43. The rod forming apparatus of claim 42, wherein a width and a depth of the discharge end each are about 5-10 mm.

44. The rod forming apparatus of claim 34, wherein a first length of the first tapered entrance and a second length of the second tapered entrance are each about 5-10% of the first longitudinal length of the major body.

45. The rod forming apparatus of claim 29, wherein the first longitudinal length of the major body is about 115-160 mm.

46. The rod forming apparatus of claim 29, wherein the finishing section further includes:

an adhesive applicator, the adhesive applicator being configured to apply an adhesive to a portion of at least one covering, after the at least one covering passes through the compression box, one or more folders downstream of the compression box, the one or more folders being configured to fold the at least one covering, with the adhesive, around a tobacco rod formed by the compression box, and a cutter, the cutter being configured to cut the tobacco rod into rolled consumer products.

47. The rod forming apparatus of claim 29, wherein the in-feed section further includes:

an upper belt and an in-feed belt, the upper belt and the in-feed belt defining a descending channel, the descending channel being configured to convey a column of tobacco in the downward direction, a pair of squeeze bars configured to receive the column of tobacco from the descending channel, the pair of squeeze bars being configured to compress the column of tobacco, the pair of squeeze bars at least partially defining the discharge end of the in-feed section, a lower belt configured to move the column of tobacco through the pair of squeeze bars and into the finishing section, and the lower belt being further configured to move the at least one covering, below the column of tobacco, into the finishing section.

48. A method, comprising:

aligning one of a first channel or a second channel of a tongue with a first groove, the first groove being defined by a lower plate of a compression box of a rod forming apparatus, the tongue including, a major body, the major body having a first longitudinal length that runs from a first end to a second end of the major body, the major body including, the first channel defined along a first edge of the major body, the second channel defined along a second edge of the major body, the first channel and the second channel being hollow and running substantially along the first longitudinal length from the first end to the second end of the major body, the first channel and the second channel opposing each other and facing away from each other.

49. The method of claim 48, further comprising:

inserting the tongue into a hollow body of a tongue holder in a direction that is toward a first end of the tongue holder, until the tongue is wedged within the hollow body;

attaching the tongue holder to an arm of a tongue support assembly; and using the tongue support assembly to align one of the first channel or the second channel with the first groove, and wherein the hollow body includes ribs that oppose each other, the ribs converging towards each other from a second end to the first end of the hollow body, a first sidewall and a second sidewall of the tongue both converging towards each other along the first longitudinal length of the major body so that the first sidewall and the second sidewall are conformed to a shape of the ribs to allow the tongue to be wedged within the hollow body.

* * * * *